US010538710B2

(12) United States Patent
Clark et al.

(10) Patent No.: US 10,538,710 B2
(45) Date of Patent: Jan. 21, 2020

(54) HYDROGEN SULFIDE SCAVENGERS

(71) Applicant: Ecolab USA Inc., St. Paul, MN (US)

(72) Inventors: Jeffery Caleb Clark, Sugar Land, TX (US); Matthew Trevino, Houston, TX (US); Lawrence J. Karas, Missouri City, TX (US); Julian M. Gallardo, III, Pearland, TX (US); Prakasa Anantaneni, Richmond, TX (US); Rafaela Carvalhal Passos, Valentios (BR); Christopher Burrell, Houston, TX (US); Geeta Rana, Sugar Land, TX (US)

(73) Assignee: ECOLAB USA INC., St. Paul, MN (US)

( * ) Notice: Subject to any disclaimer, the term of this patent is extended or adjusted under 35 U.S.C. 154(b) by 0 days.

(21) Appl. No.: 16/034,018

(22) Filed: Jul. 12, 2018

(65) Prior Publication Data

US 2019/0016966 A1 Jan. 17, 2019

Related U.S. Application Data

(60) Provisional application No. 62/532,030, filed on Jul. 13, 2017.

(51) Int. Cl.
*C10G 29/20* (2006.01)
*C10L 3/10* (2006.01)

(52) U.S. Cl.
CPC ..... *C10G 29/20* (2013.01); *C10L 3/103* (2013.01); *C10G 2300/202* (2013.01); *C10L 2290/545* (2013.01)

(58) Field of Classification Search
CPC ..... C10G 29/20
See application file for complete search history.

(56) References Cited

U.S. PATENT DOCUMENTS

| | | | |
|---|---|---|---|
| 169,949 | A | 12/1875 | Brown et al. |
| 2,776,870 | A | 1/1957 | Fischer |
| 2,878,294 | A | 3/1959 | Kress |
| 2,900,350 | A | 8/1959 | Kirkpatrick |
| 3,071,433 | A | 1/1963 | Dunn |
| 3,458,444 | A | 7/1969 | Shepherd et al. |

(Continued)

FOREIGN PATENT DOCUMENTS

| | | | |
|---|---|---|---|
| CA | 1257606 | A | 7/1989 |
| CA | 1283397 | C | 4/1991 |

(Continued)

OTHER PUBLICATIONS

Machine translation CN 103691277. Apr. 2, 2014. (Year: 2014).*

(Continued)

*Primary Examiner* — Philip Y Louie
*Assistant Examiner* — Alyssa L Cepluch
(74) *Attorney, Agent, or Firm* — Eric D. Babych; Barnes & Thornburg LLP

(57) ABSTRACT

Disclosed herein are scavenging compounds and compositions useful in applications relating to the production, transportation, storage, and separation of crude oil and natural gas. Also disclosed herein are methods of using the compounds and compositions as scavengers, particularly in applications relating to the production, transportation, storage, and separation of crude oil and natural gas.

17 Claims, 3 Drawing Sheets

Graph No. 1

(56) References Cited

U.S. PATENT DOCUMENTS

| | | | | |
|---|---|---|---|---|
| 3,519,691 | A | 7/1970 | von Portatius | |
| 3,855,210 | A | 12/1974 | Keller | |
| 3,880,784 | A | 4/1975 | Wagner et al. | |
| 3,888,668 | A | 6/1975 | Keller | |
| 4,036,942 | A | 7/1977 | Sibeud et al. | |
| 4,107,106 | A | 8/1978 | Dunleavy et al. | |
| 4,195,151 | A | 3/1980 | Dunleavy et al. | |
| 4,327,092 | A | 4/1982 | Collington et al. | |
| 4,342,756 | A | 8/1982 | Collington et al. | |
| 4,410,436 | A | 10/1983 | Holstedt et al. | |
| 4,412,928 | A | 11/1983 | Holstedt et al. | |
| 4,557,843 | A | 12/1985 | Holstedt et al. | |
| 4,623,474 | A | 11/1986 | Holstedt et al. | |
| 4,627,930 | A | 12/1986 | Holstedt et al. | |
| 4,629,579 | A | 12/1986 | Jessup et al. | |
| 4,629,580 | A | 12/1986 | Holstedt et al. | |
| 4,657,686 | A | 4/1987 | Holstedt et al. | |
| 4,680,127 | A | 7/1987 | Edmondson | |
| 4,724,099 | A | 2/1988 | Holstedt et al. | |
| 4,748,011 | A | 5/1988 | Baize | |
| 4,756,842 | A | 7/1988 | Holstedt et al. | |
| 4,760,133 | A | 7/1988 | Niwa et al. | |
| 4,801,729 | A | 1/1989 | Holstedt et al. | |
| 4,892,670 | A | 1/1990 | Mendelson | |
| 4,976,935 | A * | 12/1990 | Lynn | B01D 53/1468 423/222 |
| 5,213,680 | A | 5/1993 | Kremer et al. | |
| 5,304,361 | A | 4/1994 | Parisi | |
| 5,700,438 | A | 12/1997 | Miller | |
| 6,048,968 | A | 4/2000 | Etzbach et al. | |
| 6,267,913 | B1 | 7/2001 | Marder et al. | |
| 6,544,492 | B1 | 4/2003 | DeBerry | |
| 6,608,228 | B1 | 8/2003 | Cumpston et al. | |
| 6,942,037 | B1 | 9/2005 | Arnold et al. | |
| 7,078,005 | B2 * | 7/2006 | Smith | C10L 3/10 423/226 |
| 7,235,194 | B2 | 6/2007 | Cumpston et al. | |
| 7,438,877 | B2 | 10/2008 | Salma et al. | |
| 7,781,187 | B2 | 8/2010 | Gasper et al. | |
| 8,173,635 | B2 | 5/2012 | Jimenez et al. | |
| 8,197,722 | B2 | 6/2012 | Marder et al. | |
| 8,367,697 | B2 | 2/2013 | Jimenez et al. | |
| 8,597,549 | B2 | 12/2013 | Cumpston et al. | |
| 8,734,637 | B2 | 5/2014 | Taylor | |
| 9,347,010 | B2 | 5/2016 | Gonzalez et al. | |
| 9,468,882 | B2 | 10/2016 | Laroche et al. | |
| 9,523,045 | B2 | 12/2016 | Harrington et al. | |
| 2002/0185634 | A1 | 12/2002 | Marder et al. | |
| 2004/0086443 | A1 | 5/2004 | Schield et al. | |
| 2004/0096382 | A1 | 5/2004 | Smith et al. | |
| 2004/0110984 | A1 | 6/2004 | Cumpston et al. | |
| 2005/0238556 | A1 | 10/2005 | Pakulski et al. | |
| 2007/0154980 | A1 | 7/2007 | Gasper et al. | |
| 2008/0283804 | A1 | 11/2008 | Cumpston et al. | |
| 2009/0291937 | A1 | 11/2009 | Jimenez et al. | |
| 2011/0031165 | A1 | 2/2011 | Karas et al. | |
| 2011/0155646 | A1 | 6/2011 | Karas et al. | |
| 2011/0220551 | A1 | 9/2011 | Taylor | |
| 2012/0149680 | A1 | 6/2012 | Jimenez et al. | |
| 2012/0012507 | A1 | 9/2012 | Compton et al. | |
| 2012/0241361 | A1 | 9/2012 | Ramachandran et al. | |
| 2013/0172623 | A1 | 7/2013 | Kaplan | |
| 2013/0240409 | A1 | 9/2013 | Subramaniyam | |
| 2013/0274426 | A1 | 10/2013 | Sugiura et al. | |
| 2013/0299734 | A1 | 11/2013 | Yang et al. | |
| 2014/0041893 | A1 | 2/2014 | Adams et al. | |
| 2014/0166282 | A1 | 6/2014 | Martinez et al. | |
| 2014/0166288 | A1 | 6/2014 | Bailey et al. | |
| 2014/0166289 | A1 | 6/2014 | Martinez et al. | |
| 2014/0190870 | A1 * | 7/2014 | Lehrer | C10G 29/06 208/240 |
| 2014/0209510 | A1 | 7/2014 | Harrington et al. | |
| 2014/0234191 | A1 | 8/2014 | Laroche et al. | |
| 2015/0175877 | A1 | 6/2015 | Shindgikar et al. | |
| 2016/0312141 | A1 | 10/2016 | Rana et al. | |
| 2017/0066977 | A1 | 3/2017 | Rana et al. | |
| 2018/0221811 | A1 | 8/2018 | Vorberg et al. | |

FOREIGN PATENT DOCUMENTS

| | | | |
|---|---|---|---|
| CN | 1757796 | A | 4/2006 |
| CN | 1814595 | A | 8/2006 |
| CN | 1309868 | C | 4/2007 |
| CN | 101037541 | A | 9/2007 |
| CN | 100503595 | C | 6/2009 |
| CN | 102993047 | A | 3/2013 |
| CN | 103012199 | A | 4/2013 |
| CN | 103018237 | A | 4/2013 |
| CN | 103691277 | A * | 4/2014 |
| CN | 102993047 | B | 9/2014 |
| CN | 103018237 | B | 9/2014 |
| DE | 219030 | | 12/1908 |
| DE | 236746 | | 11/1910 |
| DE | 1092002 | | 11/1960 |
| DE | 2729918 | A1 | 1/1979 |
| DE | 3301822 | A1 | 8/1983 |
| DE | 3925256 | A1 | 1/1991 |
| DE | 19820400 | A1 | 11/1999 |
| EP | 0202600 | A2 | 11/1986 |
| EP | 411409 | A1 | 2/1991 |
| EP | 955342 | B1 | 7/2001 |
| EP | 1363985 | B1 | 8/2007 |
| EP | 2364768 | A1 | 9/2011 |
| GB | 1107057 | A | 3/1968 |
| GB | 1107244 | A | 3/1968 |
| GB | 2114144 | B | 7/1985 |
| JP | S58129059 | A | 8/1983 |
| JP | H01271416 | A | 10/1989 |
| JP | H03099038 | A | 4/1991 |
| JP | 2000026746 | A | 1/2000 |
| JP | 2006219506 | A | 8/2006 |
| JP | 2009522406 | A | 6/2009 |
| JP | 2011038215 | A | 2/2011 |
| JP | 5441053 | B2 | 3/2014 |
| PL | 144233 | B1 | 4/1988 |
| RU | 2118649 | C1 | 9/1998 |
| RU | 2197605 | | 1/2003 |
| RU | 2220756 | | 1/2004 |
| RU | 2246342 | | 2/2005 |
| RU | 2246342 | C1 | 2/2005 |
| RU | 2305123 | | 8/2007 |
| RU | 2372341 | | 11/2009 |
| RU | 2008122310 | A | 12/2009 |
| RU | 2404175 | C2 | 11/2010 |
| RU | 2466175 | C2 | 11/2010 |
| RU | 2418036 | C1 | 5/2011 |
| RU | 2009143509 | A | 5/2011 |
| RU | 2470987 | C1 | 12/2012 |
| RU | 2490311 | C1 | 8/2013 |
| WO | WO 9007467 | | 7/1990 |
| WO | WO 98/21521 | A1 | 5/1998 |
| WO | WO 02/051968 | A1 | 7/2002 |
| WO | WO 2007/078926 | A2 | 7/2007 |
| WO | WO 2008/027721 | A1 | 3/2008 |
| WO | WO 2008/155333 | A1 | 12/2008 |
| WO | WO 2014/025577 | A1 | 2/2014 |
| WO | WO 2012/086189 | A1 | 5/2014 |
| WO | WO 2016/030262 | A1 | 3/2016 |
| WO | WO 2016/100224 | A2 | 6/2016 |
| WO | WO 2018/001629 | | 1/2018 |
| WO | WO 2018/001630 | | 1/2018 |
| WO | WO 2018/001631 | | 1/2018 |

OTHER PUBLICATIONS

Bakke, Jan M., et al., "Hydrogen Sulfide Scavenging by 1,3,5-Triazinanes. Comparison of the Rates of Reaction." *Industrial & Engineering Chemistry Research,* 43:1962-1965 (2004).

CAS Registry No. 120-07-0, entered STN: Nov 16, 1984, 2 pages.

CAS Registry No. 3077-12-1, entered STN: Nov. 16, 1984, 2 pages.

CAS Registry No. 30525-89-4, entered STN: Nov. 16, 1984, 2 pages.

(56) References Cited

OTHER PUBLICATIONS

CAS Registry No. 50-00-0, entered STN: Nov. 16, 1984, 2 pages.
International Search Report and Written Opinion for International Application No. PCT/US2014/013818, 9 pages (dated May 28, 2014).
International Search Report and Written Opinion for International Application No. PCT/US2016/046813, 10 pages (dated Nov. 23, 2016).
International Preliminary Report on Patentability for International Application No. PCT/US2016/046813, 7 pages (dated Mar. 22, 2018).
International Search Report and Written Opinion for International Application No. PCT/US2016/046832, 9 pages (dated Nov. 23, 2016)
International Search Report and Written Opinion for International Application No. PCT/US2017/044099, 11 pages (dated Oct. 26, 2017).
International Search Report and Written Opinion from related PCT App. No. PCT/US2016/028534, dated Jun. 30, 2016 (12 pages).
Kozyukov, V.P., et al., *Journal of General Chemistry of the USSR,* Translated from Russian. New York: Consultants Bureau, pp. 1222-1229 (1982).
Kreulen, H., et al., "Selective removal of H2S from sour gases with microporous membrances. Part II. A liquid membrance of water-free teriary amines," *J Membrane Sci,* 82:185-197 (1993).
Pudovik, et al., *Journal of General Chemistry of the USSR,* Translated from Russian. New York: Consultants Bureau, pp. 407-408 (1990).
STN search, 3 pages (Mar. 6, 2018).
STN search, 60 pages (Mar. 4, 2016).
"Sul-free H2S & Acid Gas Eliminator," 6 pages, undated, but to the best of undersigned attorney's belief and knowledge is believed to be prior to the filed of this application, (2017).
Amararene, Fatiha et al., "Study of Hydrogen Sulfide Absorption with Diethanolamine in Methanolic Aqueous Solutions" Chemical Engineering Transactions (2016) 52: 259-264.
Mandal, B.P. et al, "Selective absorption of $H_2S$ from gas streams containing $H_2S$ and $CO_2$ into aqueous solutions of N-methyldiethanolamine and 2-amino-2-methyl-1-propanol" Separation and Purification Technology (2004) 35: 191-202.
Mandal, B.P. et al, "Simultaneous absorption of carbon dioxide and hydrogen sulfide into aqueous blends of 2-amino-2-methyl-1-propanol and diethanolamine" Chemical Engineering Science (2005) 60: 6438-6451.
Al Sasi, Basil Omar et al., "Removal of sulfur from sulfur-bearing natural gas to produce clean jet fuel" Petroleum Science and Technology (2016) 34(17-18): 1550-1555.
STN Search, 23 pages (Aug. 29, 2018).
Riesenfeld, F.C. et al., "Tertiary ethanolamines more economical for removal of $H_2S$ and carbon dioxide" Oil & Gas Journal (1986) 61-65.
European Search Report for European Application No. 16783814.3, 8 pages (dated Oct. 2, 2018).
Benn, M.H., et al., "Cytotoxic compounds. I. p-(N,N-di-2-chloroethyl)- and p-(N,N-di-2-bromoethylamino)thiophenol," Journal of the Chemical Society, 2800-10 (1958).
Bennett, E. O., "Corrosion inhibitors as preservatives for metal-working fluids—ethanolamines," Lubrication Engineering, 35(3):137-44 (1979).
Bradshaw, Jerald S., "Synthesis of macrocylic acetals containing lipophilic substituents," Tetrahedron, 43(19):4271-6 (1987).
Clerici, A., et al., "A New One-Pot, Four-Component Synthesis of 1,2-Amino Alcohols: TiCl3/t-BuOOH-Mediated Radical Hydroxymethylation of Imines," Organic Letters, 10(21):5063-5066 (2008).
Friedli, A., et al., "A convenient synthetic entry into aldehydes with extended conjugation," Tetrahedron, 53(8):2717-2730 (1997).
Friedli, A., et al., "A convenient synthetic entry into aldehydes with extended conjugation," Tetrahedron, 53(18):6233-6234 (1997).
Guo, C., et al., "Synthesis of new aromatic aldehydes bearing nitrogen mustard derivatives and haloalkylpiperazinyl," Youji Huaxue, 25(3):308-312 (2005).
International Search Report and Written Opinion for International Application No. PCT/US2018/041758, 11 pages (dated Sep. 28, 2018).
Li, F., et al., "Synthesis of γ-N-arylideneaminopropyl-2-methy1-6-phenyl-1,3-dioxa-6-aza-2-silacyclooctanes," Synthetic Communications, 31(23):3715-3720 (2001).
Ma, H., et al., "A novel synthesis of side-chain electro-optic polyimides with high azo chromophore density," European Polymer Journal, 34(8):1125-1132 (1998).
Massin, J., et al., "Near-Infrared Solid-State Emitters Based on Isophorone: Synthesis, Crystal Structure and Spectroscopic Properties," Chemistry of Materials, 23(3):862-873 (2011).
Nishiyama, T., et al., "Synthesis and NMR spectra of 6-phenyl-5,6,7,8-tetrahydro-4H-1,3,6-dioxazocines," Journal of Heterocyclic Chemistry, 23(1):69-71 (1986).
Shen, S., et al., "Mechanistic study of the oxidation of N-phenyldiethanolamine by bis(hydrogen periodato)argentate(III) complex anion," Transition Metal Chemistry, 32(2):167-171 (2007).
"Sul-free H2S & Acid Gas Eliminator," 6 pages, undated, but to the best of undersigned attorney's belief and knowledge is believed to be prior to the filed of this application, 2018.
Yin, D., et al., "Synthesis of a novel organic nonlinear optical molecule MC-FTC," Huaxue Xuebao, 62(5):518-522 (2004).
Zhao, Y., et al., "A highly selective colorimetric chemodosimeter for fast and quantitative detection of hydrogen sulfide," Analyst (Cambridge, United Kingdom), 137(23):5576-5580 (2012).
Zhou, L., et al., "NLO Polymers Containing Anionic Chromophore," Journal of Macromolecular Science, Part A: Pure and Applied Chemistry, A42(10):1423-1434 (2005).
Zhou, L., et al., "Novel crosslinked nonlinear optical materials based on cellulose diacetate," Journal of Applied Polymer Science, 100(4):2832-2837 (2006).
Unknown, "Naval Research Laboratory" Naval Research Laboratory, Jan. 1, 1900, pp. 29-30.
Walker, J. Frederic, "Formaldehyde" Reinhold Publishing Corporation, 1964, Ed. Third Edition; p. 264.

* cited by examiner

Glycerin Hemi-Formyl vs. Catalyzed with Molecule A

Graph No. 1

Graph No. 2

Bubble Tower Test GT-227 *neat* and GT-227 *plus* 3% TEA at Equal Actives and Concentration (0.2M)

Graph No. 3

HYDROGEN SULFIDE SCAVENGERS

TECHNICAL FIELD

The present disclosure generally relates to scavengers of sulfur-based species and methods of scavenging sulfur-based species. More particularly, the disclosure relates to methods of scavenging sulfur-containing compounds, such as hydrogen sulfide and/or mercaptans, using compositions comprising a compound containing an amine group and a hemiacetal compound.

BACKGROUND

The removal of sulfur-based species from liquid or gaseous hydrocarbon streams is a problem that has long challenged many industries. Hydrogen sulfide is a major problem in the oil industry, particularly in the drilling, production, transportation, storage, and processing of crude oil, as well as wastewater associated with crude oil. The same problems exist in the natural gas industry.

The presence of sulfur-containing compounds, such as hydrogen sulfide, can result in the deposition of sulfur containing salts, which can cause plugging and corrosion of transmission pipes, valves, regulators and other process equipment. Even flared natural gas needs to be treated to avoid acid rain generation due to $SO_x$ formation. Also, in the manufactured gas industry or coke making industry, coal-gas emissions containing unacceptable levels of hydrogen sulfide are commonly produced from destructive distillation of bituminous coal.

Since hydrogen sulfide has an offensive odor and natural gas containing hydrogen sulfide is called "sour" gas, treatments to lower hydrogen sulfide may be referred to as "sweetening" processes. When a particular compound is used to remove or lower hydrogen sulfide, it may be referred to as a hydrogen sulfide scavenger.

SUMMARY

In accordance with certain embodiments of the present disclosure, a method of removing a sulfur-containing compound from a stream is provided. The method comprises adding a composition to the stream comprising the sulfur-containing compound, the composition comprising a compound containing an amine group and a hemiacetal compound.

In some embodiments, the stream is a liquid or a gaseous stream comprising a hydrocarbon.

In some embodiments, the sulfur-containing compound is hydrogen sulfide.

In some embodiments, the compound containing the amine group is a tertiary alkylamine compound or a tertiary alkanolamine compound.

In some embodiments, the compound containing the amine group comprises formula (I):

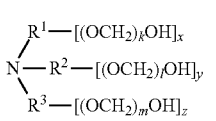

(I)

wherein $R^1$, $R^2$, and $R^3$ are each independently selected from the group consisting of hydrogen, alkylenyl, alkenylenyl, alkynylenyl, alkyl, alkenyl, alkynyl, substituted alkyl and aromatic, wherein said alkylenyl, alkenylenyl, alkynylenyl, alkyl, alkenyl, and alkynyl are each independently, at each occurrence, substituted or unsubstituted with one or more suitable substituents;

k, l, and m are each independently an integer selected from the group consisting of 0 to 25, wherein k+l+m is ≥0; and x, y, and z are each independently an integer selected from the group consisting of 0 and 1, wherein x+y+z is 1, 2, or 3;

provided that:

when x is 0, $R^1$ is hydrogen, alkyl, alkenyl, or alkynyl; and when x is 1, $R^1$ is alkylenyl, alkenylenyl, or alkynylenyl;

when y is 0, $R^2$ is hydrogen, alkyl, alkenyl, or alkynyl; and when y is 1, $R^2$ is alkylenyl, alkenylenyl, or alkynylenyl;

when z is 0, $R^3$ is hydrogen, alkyl, alkenyl, or alkynyl; and when z is 1, $R^3$ is alkylenyl, alkenylenyl, or alkynylenyl; and when x is 1, y is 1, z is 1, k is 1, l is 1, and m is 1, then $R^1$, $R^2$, and $R^3$ are not simultaneously unsubstituted $C_2$-alkylenyl.

In some embodiments, the "substituted alkyl" group comprises an alkyl group substituted with nitrogen, such as in

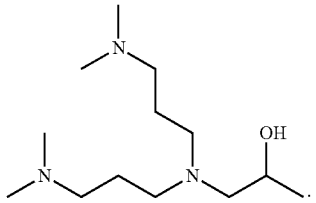

1-(bis(3-(dimethylamino)propyl)amino)propan-2-ol

In some embodiments, the aromatic group comprises benzene or a substituted benzene, such as toluene, bromobenzene, aniline, etc.

In some embodiments, x+y+z is 3, k+l+m is 0, $R^1$ and $R^2$ are both alkylenyl, and $R^3$ is alkyl.

In some embodiments, x+y+z is 3, k+l+m is 0, $R^1$ is alkylenyl, and $R^2$ and $R^3$ are both alkyl.

In some embodiments, x+y+z is 3, k+l+m is 0, $R^1$ and $R^2$ are both alkylenyl, and $R^3$ is aryl.

In some embodiments, the compound containing the amine group is selected from the group consisting of:

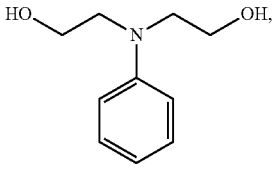

2,2′-(phenylazanediyl) bis(ethan-1-ol)

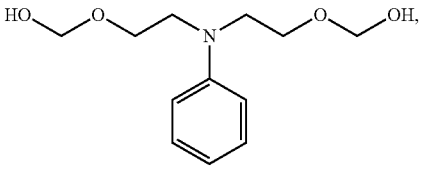

(((phenylazanediyl)bis (ethane-2,1-diyl))bis(oxy))dimethanol

-continued

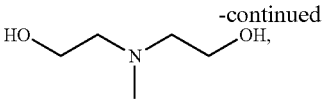

2,2′-(methylazanediyl) bis(ethan-1-ol)

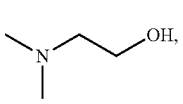

2-(dimethylamino)ethan-1-ol

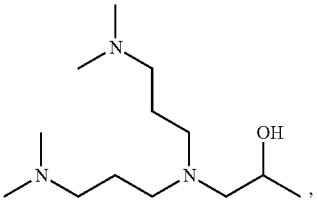

1-(bis(3-(dimethylamino)propyl) amino)propan-2-ol

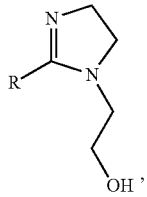

Imidazoline Mixtures
R = $C_2$-$C_{17}$

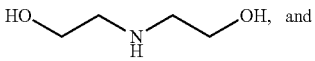

2,2′-azanediylbis(ethan-1-ol)

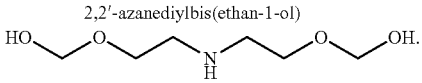

((azanediylbis(ethane-2,1-diyl))bis(oxy))dimethanol

In some embodiments, the compound containing the amine group is

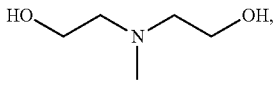

2,2′-(methylazanediyl)bis(ethan-1-ol)

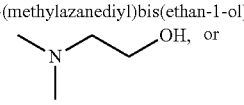

2-(dimethylamino)ethan-1-ol

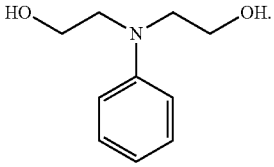

2,2′-(phenylazanediyl)bis(ethan-1-ol)

In some embodiments, the compound containing the amine group comprises formula (II),

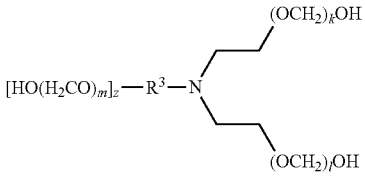

(II)

wherein $R^3$ is selected from the group consisting of hydrogen, alkylenyl, alkenylenyl, alkynylenyl, alkyl, alkenyl, and alkynyl, wherein said alkylenyl, alkenylenyl, alkynylenyl, alkyl, alkenyl, and alkynyl are each independently substituted or unsubstituted with one or more suitable substituents;

k, l, and m are each independently an integer selected from the group consisting of 0 to 25, wherein k+l+m is ≥0; and z is 0 or 1;

provided that:

when z is 1, $R^3$ is alkylenyl, alkenylenyl, or alkynylenyl;

when z is 0, $R^3$ is hydrogen, alkyl, alkenyl, or alkynyl; and when z is 1, k is 1, l is 1, and m is 1, then $R^3$ is not an unsubstituted $C_2$-alkylenyl.

In some embodiments, the hemiacetal compound comprises the following Structure 1:

Structure 1

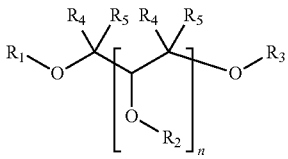

wherein n=0, 1, or 2;

$R_1$, $R_2$, and $R_3$=H or —$(CR_4R_5—O—)_m$—H;

m=0, 1, or 2; and $R_4$ and $R_5$=H, substituted or unsubstituted alkyl, and substituted or unsubstituted aryl.

In some embodiments, the hemiacetal compound comprises the following structure 2:

Structure 2

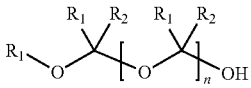

wherein n=0, 1, or 2; and $R_1$ and $R_2$=H, substituted or unsubstituted alkyl, and substituted or unsubstituted aryl.

In some embodiments, the hemiacetal compound is selected from the group consisting of

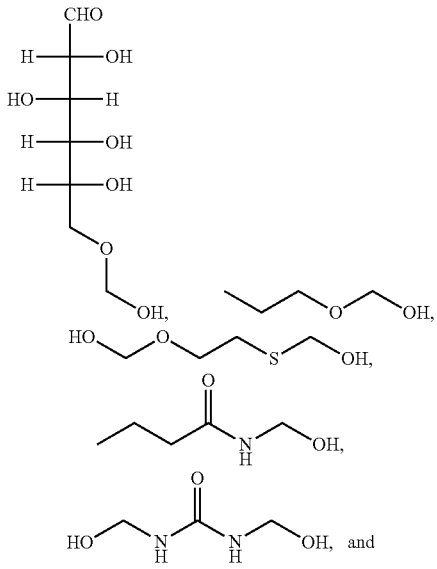

-continued

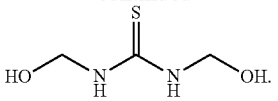

In some embodiments, the hemiacetal compound is selected from the group consisting of

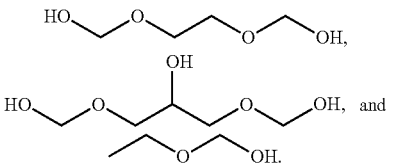

In some embodiments, the hemiacetal comprises

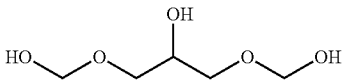

((2-hydroxypropane-1,3-diyl)bis(oxy))dimethanol and the compound containing the amine group comprises

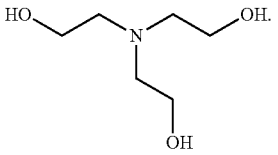

2,2′,2″−nitrilotris(ethan-1-ol)

In some embodiments, the hemiacetal comprises

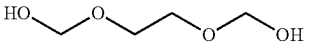

(ethane-1,2-diylbis(oxy))dimethanol and the compound containing the amine group comprises

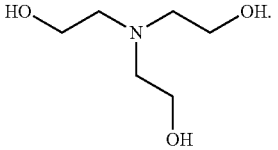

2,2′,2″-nitrilotris(ethan-1-ol)

The present disclosure also provides for the use of a composition to remove a sulfur-containing compound from a stream, wherein the composition comprises a compound containing an amine group and a hemiacetal compound, wherein the composition is added to the stream.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which.

DETAILED DESCRIPTION BRIEF DESCRIPTION OF THE SEVERAL VIEWS OF THE DRAWINGS

Figure 1:
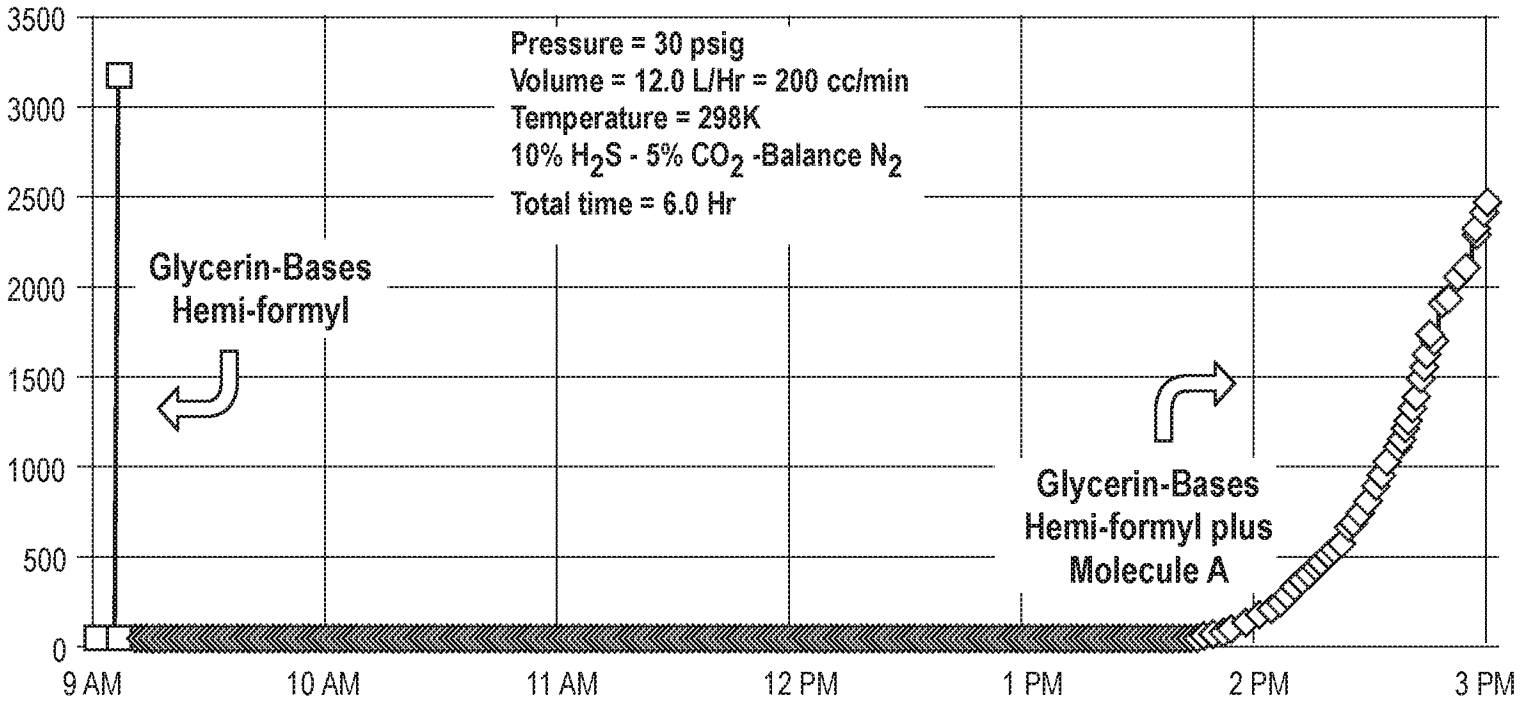
FIGS. 1-3 show results from experiments testing certain hemiacetal compounds against certain hemiacetal compounds in combination with certain compounds comprising amine groups.

Disclosed herein are hydrogen sulfide and/or mercaptan scavenging compounds and compositions, and methods of using said compounds and compositions. The compounds and compositions are particularly useful in the control of hydrogen sulfide and/or mercaptan emissions from crude oil based, natural gas based, and coal based products and processes. The compounds and compositions are applicable to both upstream and downstream processes. The scavenging compounds and compositions, optionally blended with aqueous and/or non-aqueous solvents, are useful in a wide range of climates and under a wide range of process conditions.

In certain embodiments, the compounds and compositions may be obtained in anhydrous form, thereby providing use in processes where it is desirable to minimize water content (e.g., in an oil production process). Using the compounds and compositions in anhydrous form also allows for reduced transportation costs. The anhydrous compounds and compositions can optionally be blended with hydrophilic solvents (e.g., alcohols, glycol, polyols) for non-aqueous applications. Alternatively, the compounds and compositions may be blended with an aqueous phase for direct use in aqueous applications.

As is further described and exemplified below, the inventors unexpectedly discovered synergy between certain components of the compositions disclosed herein. For example, synergy was discovered between hemiacetal compounds and compounds containing amine groups. In some embodiments, the addition of the compound containing the amine group was unexpectedly found to increase the kinetic rate of the reaction between the hemiacetal compound and the hydrogen sulfide.

In accordance with certain embodiments, the inventors unexpectedly discovered that the addition of certain amounts of tertiary amines, such as triethanolamine, to non-amine-containing hemiformyl compounds, such as ethylene glycol hemiformyl or a glycerin-based hemiformyl, yields a substantial increase in hydrogen sulfide removal. Tertiary amines cannot readily form a triazine molecule in the presence of formaldehyde. However, the contained nitrogen atom in an amine, such as a tertiary amine (e.g., triethanolamine) is well-suited to catalyze hydrogen sulfide removal.

In addition to simply adding an amine, such as triethanolamine, as a catalyst, the hemiformyl of the amine was also examined for its ability to function as a catalyst while simultaneously increasing the overall molar hydrogen sulfide removal capacity.

1. Definition of Terms

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "and" and "the" include plural references unless the context clearly dictates otherwise. The present disclosure also contemplates other embodiments "comprising," "consisting of" and "consisting essentially of," the embodiments or elements presented herein, whether explicitly set forth or not.

Any composition disclosed herein may comprise, consist of, or consist essentially of any of the compounds/components disclosed herein. In accordance with the present disclosure, the phrases "consist essentially of," "consists essentially of," "consisting essentially of," and the like limit the scope of a claim to the specified materials or steps and those materials or steps that do not materially affect the basic and novel characteristic(s) of the claimed invention.

The term "suitable substituent," as used herein, is intended to mean a chemically acceptable functional group, preferably a moiety that does not negate the hydrogen sulfide scavenging activity of the inventive compounds. Such suitable substituents include, but are not limited to halo groups, perfluoroalkyl groups, perfluoroalkoxy groups, alkyl groups, alkenyl groups, alkynyl groups, hydroxy groups, oxo groups, mercapto groups, alkylthio groups, alkoxy groups, aryl or heteroaryl groups, aryloxy or heteroaryloxy groups, aralkyl or heteroaralkyl groups, aralkoxy or heteroaralkoxy groups, HO—(C═O)— groups, heterocylic groups, cycloalkyl groups, amino groups, alkyl- and dialkylamino groups, carbamoyl groups, alkylcarbonyl groups, alkoxycarbonyl groups, alkylaminocarbonyl groups, dialkylamino carbonyl groups, arylcarbonyl groups, aryloxycarbonyl groups, alkylsulfonyl groups, arylsulfonyl groups, groups of formula —$(OCH_2)_tOH$ wherein t is 1 to 25, and groups of formula -alkylenyl-$(OCH_2)_tOH$ wherein t is 1 to 25. Those skilled in the art will appreciate that many substituents can be substituted by additional substituents.

The term "alkyl," as used herein, refers to a linear or branched hydrocarbon radical, preferably having 1 to 32 carbon atoms (i.e., 1, 2, 3, 4, 5, 6, 7, 8, 9, 10, 11, 12, 13, 14, 15, 16, 17, 18, 19, 20, 21, 22, 23, 24, 25, 26, 27, 28, 39, 30, 31, or 32 carbons). Alkyl groups include, but are not limited to, methyl, ethyl, n-propyl, isopropyl, n-butyl, iso-butyl, secondary-butyl, and tertiary-butyl. Alkyl groups may be unsubstituted or substituted by one or more suitable substituents, as defined above.

The term "alkylenyl" or "alkylene," as used herein, refers to a divalent group derived from a saturated, straight or branched hydrocarbon chain of from 1 to 32 carbon atoms. The term "$C_1$-$C_6$ alkylene" means those alkylene or alkylenyl groups having from 1 to 6 carbon atoms. Representative examples of alkylenyl groups include, but are not limited to, —$CH_2$—, —$CH(CH_3)$—, —$CH(C_2H_5)$—, —$CH(CH(CH_3)(C_2H_5))$—, —$C(H)(CH_3)CH_2CH_2$—, —$C(CH_3)_2$—, —$CH_2CH_2$—, —$CH_2CH_2CH_2$—, —$CH_2CH_2CH_2CH_2$—, and —$CH_2CH(CH_3)CH_2$—. Alkylenyl groups may be unsubstituted or substituted by one or more suitable substituents, as defined above.

The term "alkenyl," as used herein, refers to a straight or branched hydrocarbon radical, preferably having 2, 3, 4, 5, 6, 7, 8, 9, 10, 11, 12, 13, 14, 15, 16, 17, 18, 19, 20, 21, 22, 23, 24, 25, 26, 27, 28, 39, 30, 31, or 32 carbons, and having one or more carbon-carbon double bonds. Alkenyl groups include, but are not limited to, ethenyl, 1-propenyl, 2-propenyl (allyl), iso-propenyl, 2-methyl-1-propenyl, 1-butenyl, and 2-butenyl. Alkenyl groups may be unsubstituted or substituted by one or more suitable substituents, as defined above.

The term "alkenylenyl" or "alkenylene," as used herein, refers to a divalent group derived from a straight or branched chain hydrocarbon of 2 to 32 carbon atoms, which contains at least one carbon-carbon double bond. Representative examples of alkenylenyl groups include, but are not limited to, —C(H)═C(H)—, —C(H)═C(H)—$CH_2$—, —C(H)═C(H)—$CH_2$—$CH_2$—, —$CH_2$—C(H)═C(H)—$CH_2$—, —C(H)═C(H)—$CH(CH_3)$—, and —$CH_2$—C(H)═C(H)—$CH(CH_2CH_3)$—. Alkenylenyl groups may be unsubstituted or substituted by one or more suitable substituents, as defined above.

The term "alkynyl," as used herein, refers to a straight or branched hydrocarbon radical, preferably having 2, 3, 4, 5, 6, 7, 8, 9, 10, 11, 12, 13, 14, 15, 16, 17, 18, 19, 20, 21, 22, 23, 24, 25, 26, 27, 28, 39, 30, 31, or 32 carbons, and having one or more carbon-carbon triple bonds. Alkynyl groups include, but are not limited to, ethynyl, propynyl, and butynyl. Alkynyl groups may be unsubstituted or substituted by one or more suitable substituents, as defined above.

The term "alkynylenyl" or "alkynylene," as used herein, refers to a divalent unsaturated hydrocarbon group which may be linear or branched and which has at least one carbon-carbon triple bond. Representative examples of alkynylenyl groups include, but are not limited to, C≡C—, —C≡C—$CH_2$—, —C≡C—$CH_2$—$CH_2$—, —$CH_2$—C≡C—$CH_2$—, —C≡C—$CH(CH_3)$—, and —$CH_2$—C≡C—$CH(CH_2CH_3)$—. Alkynylenyl groups may be unsubstituted or substituted by one or more suitable substituents, as defined above.

The term "alkoxy," as used herein, refers to an alkyl group, as defined herein, appended to the parent molecular moiety through an oxygen atom.

The term "aryl," as used herein, means monocyclic, bicyclic, or tricyclic aromatic radicals such as phenyl, naphthyl, tetrahydronaphthyl, indanyl and the like; optionally substituted by one or more suitable substituents, preferably 1 to 5 suitable substituents, as defined above.

The term "carbonyl," "(C═O)," or "—C(O)—" (as used in phrases such as alkylcarbonyl, alkyl —(C═O)— or alkoxycarbonyl) refers to the joinder of the >C═O moiety to a second moiety such as an alkyl or amino group (i.e. an amido group). Alkoxycarbonylamino (i.e. alkoxy(C═O)—

NH—) refers to an alkyl carbamate group. The carbonyl group is also equivalently defined herein as (C═O). Alkylcarbonylamino refers to groups such as acetamide.

The term "cycloalkyl," as used herein, refers to a mono, bicyclic or tricyclic carbocyclic radical (e.g., cyclopropyl, cyclobutyl, cyclopentyl, cyclohexyl, cycloheptyl, cyclooctyl, cyclononyl, cyclopentenyl, cyclohexenyl, bicyclo[2.2.1]heptanyl, bicyclo[3.2.1]octanyl and bicyclo[5.2.0]nonanyl, etc.); optionally containing 1 or 2 double bonds. Cycloalkyl groups may be unsubstituted or substituted by one or more suitable substituents, preferably 1 to 5 suitable substituents, as defined above.

The term "halo" or "halogen," as used herein, refers to a fluoro, chloro, bromo or iodo radical.

The term "heteroaryl," as used herein, refers to a monocyclic, bicyclic, or tricyclic aromatic heterocyclic group containing one or more heteroatoms selected from O, S and N in the ring(s). Heteroaryl groups include, but are not limited to, pyridyl, pyrazinyl, pyrimidinyl, pyridazinyl, thienyl, furyl, imidazolyl, pyrrolyl, oxazolyl (e.g., 1,3-oxazolyl, 1,2-oxazolyl), thiazolyl (e.g., 1,2-thiazolyl, 1,3-thiazolyl), pyrazolyl, tetrazolyl, triazolyl (e.g., 1,2,3-triazolyl, 1,2,4-triazolyl), oxadiazolyl (e.g., 1,2,3-oxadiazolyl), thiadiazolyl (e.g., 1,3,4-thiadiazolyl), quinolyl, isoquinolyl, benzothienyl, benzofuryl, and indolyl. Heteroaryl groups may be unsubstituted or substituted by one or more suitable substituents, preferably 1 to 5 suitable substituents, as defined above.

The term "heterocycle," as used herein, refers to a monocyclic, bicyclic, or tricyclic group containing 1 to 4 heteroatoms selected from N, O, $S(O)_n$, $P(O)_n$, $PR^x$, NH or $NR^x$, wherein $R^x$ is a suitable substituent. Heterocyclic groups optionally contain 1 or 2 double bonds. Heterocyclic groups include, but are not limited to, azetidinyl, tetrahydrofuranyl, imidazolidinyl, pyrrolidinyl, piperidinyl, piperazinyl, oxazolidinyl, thiazolidinyl, pyrazolidinyl, thiomorpholinyl, tetrahydrothiazinyl, tetrahydro-thiadiazinyl, morpholinyl, oxetanyl, tetrahydrodiazinyl, oxazinyl, oxathiazinyl, indolinyl, isoindolinyl, quinuclidinyl, chromanyl, isochromanyl, and benzoxazinyl. Examples of monocyclic saturated or partially saturated ring systems are tetrahydrofuran-2-yl, tetrahydrofuran-3-yl, imidazolidin-1-yl, imidazolidin-2-yl, imidazolidin-4-yl, pyrrolidin-1-yl, pyrrolidin-2-yl, pyrrolidin-3-yl, piperidin-1-yl, piperidin-2-yl, piperidin-3-yl, piperazin-1-yl, piperazin-2-yl, piperazin-3-yl, 1,3-oxazolidin-3-yl, isothiazolidine, 1,3-thiazolidin-3-yl, 1,2-pyrazolidin-2-yl, 1,3-pyrazolidin-1-yl, thiomorpholin-yl, 1,2-tetrahydrothiazin-2-yl, 1,3-tetrahydrothiazin-3-yl, tetrahydrothiadiazin-yl, morpholin-yl, 1,2-tetrahydrodiazin-2-yl, 1,3-tetrahydrodiazin-1-yl, 1,4-oxazin-2-yl, and 1,2,5-oxathiazin-4-yl. Heterocyclic groups may be unsubstituted or substituted by one or more suitable substituents, preferably 1 to 3 suitable substituents, as defined above.

The term "hydroxy," as used herein, refers to an —OH group.

The term "oxo," as used herein, refers to a double bonded oxygen (═O) radical wherein the bond partner is a carbon atom. Such a radical can also be thought as a carbonyl group.

The term "counterion," as used herein, means a halide (e.g., fluoride, chloride, bromide, iodide), a carboxylate anion, such as selected from deprotonation of mineral acid, acrylic acid, acetic acid, methacrylic acid, glycolic acid, thioglycolic acid, propionic acid, butyric acid, and the like, or any other anionic constituent that satisfies the charge balance necessary to form a neutral molecule.

The term "sweetening," as used herein, may refer to a process that removes sulfur species from a gas or liquid. The sulfur species may include hydrogen sulfide and mercaptans.

The term "sour gas," as used herein, may refer to a gas that includes significant amounts of sulfur species, such as hydrogen sulfide and/or mercaptans.

The term "sour liquid" or "sour fluid," as used herein, may refer to a liquid that includes significant amounts of sulfur species, such as hydrogen sulfide and/or mercaptans.

The term "water cut," as used herein, means the percentage of water in a composition containing an oil and water mixture.

2. Compounds

Compounds of the present disclosure include scavengers of sulfur-based species, such as hydrogen sulfide and mercaptans. The compounds may be particularly useful in the oil, gas, and coal industries. The compounds may be hemiacetals. The compounds may be compounds that comprise an amine group, such as tertiary alkylamine compounds and/or tertiary alkanolamine compounds. The compounds may be alkanolamine formaldehyde addition products. The compounds may be provided in anhydrous or hydrous form.

In some aspects, the compositions disclosed herein may comprise a compound containing an amine group and a hemiacetal. In some aspects, the compositions comprise a hemiacetal compound and a tertiary alkylamine and/or tertiary alkanolamine. In certain aspects, the compositions comprise a hemiacetal compound and triethanolamine. The hemiacetal compound may be, for example, glycerol bishemiformyl or glucose.

In some embodiments, the compound containing the amine group comprises the following structure:

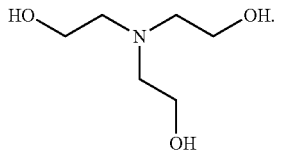

In some embodiments, the compound containing the amine group comprises the following structure:

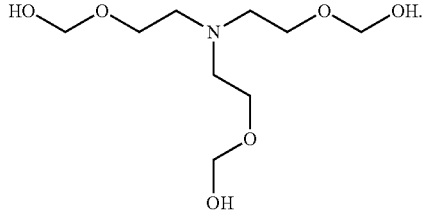

In some embodiments, the compound containing the amine group comprises the following structure:

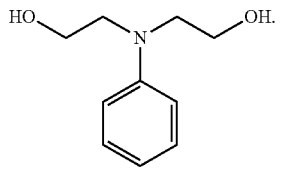

2,2′-(phenylazanediyl)bis(ethan-1-ol)

In some embodiments, the compound containing the amine group comprises the following structure:

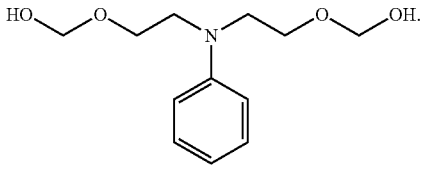

(((phenylazanediyl)bis(ethane-2,1-diyl))bis(oxy))dimethanol

In some embodiments, the compound containing the amine group comprises the following structure:

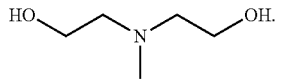

2,2′-(methylazanediyl)bis(ethan-1-ol)

In some embodiments, the compound containing the amine group comprises the following structure:

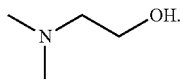

2-(dimethylamino)ethan-1-ol

In some embodiments, the compound containing the amine group comprises the following structure:

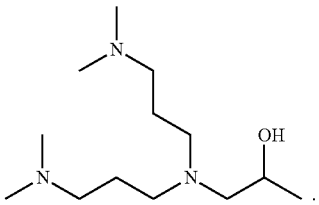

1-(bis(3-(dimethylamino)propyl)amino)propan-2-ol

In some embodiments, the compound containing the amine group comprises the following structure:

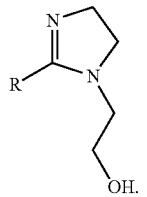

Imidazoline Mixtures

R = $C_2$-$C_{17}$

In some embodiments, the compound containing the amine group comprises the following structure:

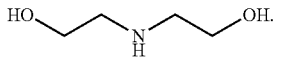

2,2′-azanediylbis(ethan-1-ol)

In some embodiments, the compound containing the amine group comprises the following structure:

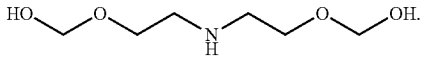

((azanediybis(ethane-2,1-diyl))bis(oxy))dimethanol

In some embodiments, the compound containing the amine group has the following formula (I),

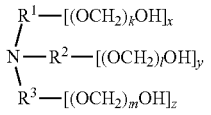

(I)

wherein, $R^1$, $R^2$, and $R^3$ are each independently selected from the group consisting of hydrogen, alkylenyl, alkenylenyl, alkynylenyl, alkyl, alkenyl, alkynyl, substituted alkyl and aromatic, wherein said alkylenyl, alkenylenyl, alkynylenyl, alkyl, alkenyl, and alkynyl are each independently, at each occurrence, substituted or unsubstituted with one or more suitable substituents;

k, l, and m are each independently an integer selected from the group consisting of 0 to 25, wherein k+l+m is ≥0; and x, y, and z are each independently an integer selected from the group consisting of 0 and 1, wherein x+y+z is 1, 2, or 3;

provided that:

when x is 0, $R^1$ is hydrogen, alkyl, alkenyl, or alkynyl; and when x is 1, $R^1$ is alkylenyl, alkenylenyl, or alkynylenyl;

when y is 0, $R^2$ is hydrogen, alkyl, alkenyl, or alkynyl; and when y is 1, $R^2$ is alkylenyl, alkenylenyl, or alkynylenyl; and when z is 0, $R^3$ is hydrogen, alkyl, alkenyl, or alkynyl; and when z is 1, $R^3$ is alkylenyl, alkenylenyl, or alkynylenyl.

It is to be understood that when x is 0, $[(OCH_2)_kOH]$ is absent; when y is 0, $[(OCH_2)_lOH]$ is absent; and when z is 0, $[(OCH_2)_mOH]$ is absent. It is also to be understood that when $R^1$ is alkylenyl, alkenylenyl, or alkynylenyl, then x must be 1; when $R^1$ is hydrogen, alkyl, alkenyl, or alkynyl, then x must be 0; when $R^2$ is alkylenyl, alkenylenyl, or alkynylenyl, then y must be 1; when $R^2$ is hydrogen, alkyl, alkenyl, or alkynyl, then y must be 0; when $R^3$ is alkylenyl, alkenylenyl, or alkynylenyl, then z must be 1; and when $R^3$ is hydrogen, alkyl, alkenyl, or alkynyl, then z must be 0.

It is also to be understood that when k>0, then x must be 1; when l>0, then y must be 1; and when m is >0, then z must be 1.

In certain embodiments, one or more of $R^1$, $R^2$, and $R^3$ are straight chain alkylenyl. In certain embodiments, one or more of $R^1$, $R^2$, and $R^3$ are branched alkylenyl. In certain embodiments, one or more of $R^1$, $R^2$, and $R^3$ are unsubstituted alkylenyl. In certain embodiments, one or more of $R^1$, $R^2$, and $R^3$ are substituted alkylenyl. In certain embodiments, one or more of $R^1$, $R^2$, and $R^3$ are straight chain, unsubstituted alkylenyl. In certain embodiments, one or more of $R^1$, $R^2$, and $R^3$ are straight chain, substituted alkylenyl. In certain embodiments, one or more of $R^1$, $R^2$, and $R^3$ are branched, unsubstituted alkylenyl. In certain embodiments, one or more of $R^1$, $R^2$, and $R^3$ are branched, substituted alkylenyl.

In certain embodiments, $R^1$, $R^2$, and $R^3$ are each straight chain alkylenyl. In certain embodiments, $R^1$, $R^2$, and $R^3$ are each branched alkylenyl. In certain embodiments, $R^1$, $R^2$, and $R^3$ are each unsubstituted alkylenyl. In certain embodiments, $R^1$, $R^2$, and $R^3$ are each substituted alkylenyl. In certain embodiments, $R^1$, $R^2$, and $R^3$ are each straight chain, unsubstituted alkylenyl. In certain embodiments, $R^1$, $R^2$, and $R^3$ are each straight chain, substituted alkylenyl. In certain embodiments, $R^1$, $R^2$, and $R^3$ are each branched, unsubstituted alkylenyl. In certain embodiments, $R^1$, $R^2$, and $R^3$ are each branched, substituted alkylenyl.

In certain embodiments, $R^1$, $R^2$, and $R^3$ are each $C_1$-$C_{32}$-alkylenyl. In certain embodiments, $R^1$, $R^2$, and $R^3$ are each $C_1$-$C_{24}$-alkylenyl. In certain embodiments, $R^1$, $R^2$, and $R^3$ are each $C_1$-$C_{10}$ alkylenyl. In certain embodiments, $R^1$, $R^2$, and $R^3$ are each $C_1$-$C_6$-alkylenyl. In certain embodiments, one or more of $R^1$, $R^2$, and $R^3$ are $C_1$-alkylenyl. In certain embodiments, one or more of $R^1$, $R^2$, and $R^3$ are unsubstituted $C_1$-alkylenyl. In certain embodiments, one or more of $R^2$, and $R^3$ are substituted $C_1$-alkylenyl. In certain embodiments, one or more of $R^1$, $R^2$, and $R^3$ are $C_2$-alkylenyl. In certain embodiments, one or more of $R^1$, $R^2$, and $R^3$ are unsubstituted $C_2$-alkylenyl. In certain embodiments, one or more of $R^1$, $R^2$, and $R^3$ are substituted $C_2$-alkylenyl. In certain embodiments, one or more of $R^1$, $R^2$, and $R^3$ are $C_3$-alkylenyl. In certain embodiments, one or more of $R^1$, $R^2$, and $R^3$ are unsubstituted $C_3$-alkylenyl. In certain embodiments, one or more of $R^2$, and $R^3$ are substituted $C_3$-alkylenyl.

In certain embodiments, one or more of $R^1$, $R^2$, and $R^3$ are $C_4$-alkylenyl. In certain embodiments, one or more of $R^1$, $R^2$, and $R^3$ are unsubstituted $C_4$-alkylenyl. In certain embodiments, one or more of $R^1$, $R^2$, and $R^3$ are substituted $C_4$-alkylenyl. In certain embodiments, one or more of $R^1$, $R^2$, and $R^3$ are $C_5$-alkylenyl. In certain embodiments, one or more of $R^1$, $R^2$, and $R^3$ are unsubstituted $C_5$-alkylenyl. In certain embodiments, one or more of $R^1$, $R^2$, and $R^3$ are substituted $C_5$-alkylenyl. In certain embodiments, one or more of $R^1$, $R^2$, and $R^3$ are $C_6$-alkylenyl. In certain embodiments, one or more of $R^1$, $R^2$, and $R^3$ are unsubstituted $C_6$-alkylenyl. In certain embodiments, one or more of $R^1$, $R^2$, and $R^3$ are substituted $C_6$-alkylenyl.

In certain embodiments, $R^1$, $R^2$, and $R^3$ are each $C_1$-alkylenyl. In certain embodiments, $R^1$, $R^2$, and $R^3$ are each unsubstituted $C_1$-alkylenyl. In certain embodiments, $R^1$, $R^2$, and $R^3$ are each substituted $C_1$-alkylenyl. In certain embodiments, $R^1$, $R^2$, and $R^3$ are each $C_2$-alkylenyl. In certain embodiments, $R^1$, $R^2$, and $R^3$ are each unsubstituted $C_2$-alkylenyl. In certain embodiments, $R^1$, $R^2$, and $R^3$ are each substituted $C_2$-alkylenyl. In certain embodiments, $R^1$, $R^2$, and $R^3$ are each $C_3$-alkylenyl. In certain embodiments, $R^1$, $R^2$, and $R^3$ are each unsubstituted $C_3$-alkylenyl. In certain embodiments, $R^1$, $R^2$, and $R^3$ are each substituted $C_3$-alkylenyl. In certain embodiments, $R^1$, $R^2$, and $R^3$ are each $C_4$-alkylenyl. In certain embodiments, $R^1$, $R^2$, and $R^3$ are each unsubstituted $C_4$-alkylenyl. In certain embodiments, $R^1$, $R^2$, and $R^3$ are each substituted $C_4$-alkylenyl. In certain embodiments, $R^1$, $R^2$, and $R^3$ are each $C_5$-alkylenyl. In certain embodiments, $R^1$, $R^2$, and $R^3$ are each unsubstituted $C_5$-alkylenyl. In certain embodiments, $R^1$, $R^2$, and $R^3$ are each substituted $C_5$-alkylenyl. In certain embodiments, $R^1$, $R^2$, and $R^3$ are each $C_6$-alkylenyl. In certain embodiments, $R^1$, $R^2$, and $R^3$ are each unsubstituted $C_6$-alkylenyl. In certain embodiments, $R^1$, $R^2$, and $R^3$ are each substituted $C_6$-alkylenyl.

In certain embodiments, when x is 1, y is 1, z is 1, k is 1, l is 1, and m is 1, then $R^1$, $R^2$, and $R^3$ are not simultaneously unsubstituted $C_2$-alkylenyl.

In certain embodiments, $R^1$ and $R^2$ are alkylenyl, and $R^3$ is alkyl. In certain embodiments, $R^1$ and $R^2$ are unsubstituted alkylenyl, and $R^3$ is unsubstituted alkyl. In certain embodiments, $R^1$ and $R^2$ are substituted alkylenyl, and $R^3$ is unsubstituted alkyl. In certain embodiments, $R^1$ and $R^2$ are substituted alkylenyl, and $R^3$ is substituted alkyl. In certain embodiments, $R^1$ and $R^2$ are unsubstituted alkylenyl, and $R^3$ is substituted alkyl.

In certain embodiments, $R^1$ and $R^2$ are $C_1$-$C_{32}$, $C_1$-$C_{16}$, $C_1$-$C_{10}$, or $C_1$-$C_6$ alkylenyl, and $R^3$ is $C_1$-$C_{32}$, $C_1$-$C_{16}$, $C_1$-$C_{10}$, or $C_1$-$C_6$ alkyl. In certain embodiments, $R^1$ and $R^2$ are unsubstituted $C_1$-$C_{32}$, $C_1$-$C_{16}$, $C_1$-$C_{10}$, or $C_1$-$C_6$ alkylenyl, and $R^3$ is unsubstituted $C_1$-$C_{32}$, $C_1$-$C_{16}$, $C_1$-$C_{10}$, or $C_1$-$C_6$ alkyl. In certain embodiments, $R^1$ and $R^2$ are unsubstituted $C_2$-alkylenyl, and $R^3$ is unsubstituted $C_1$-alkyl. In certain embodiments, $R^1$ and $R^2$ are unsubstituted $C_2$-alkylenyl, and $R^3$ is unsubstituted $C_2$-alkyl.

In certain embodiments, $R^1$ and $R^2$ are alkylenyl, and $R^3$ is hydrogen. In certain embodiments, $R^1$ and $R^2$ are unsubstituted alkylenyl, and $R^3$ is hydrogen. In certain embodiments, $R^1$ and $R^2$ are unsubstituted $C_2$-alkylenyl, and $R^3$ is hydrogen. In certain embodiments, $R^1$ and $R^2$ are substituted alkylenyl, and $R^3$ is hydrogen. In certain embodiments, $R^1$ and $R^2$ are substituted $C_2$-alkylenyl, and $R^3$ is hydrogen.

In certain embodiments, one or more of $R^1$, $R^2$, and $R^3$ are substituted with one or more suitable substituents selected from hydroxy, groups of formula —$(OCH_2)_tOH$ wherein t is 1 to 25, and groups of formula -alkylenyl-$(OCH_2)_tOH$ wherein t is 1 to 25.

In certain embodiments, k is 0 to 25, l is 0 to 25, and m is 0 to 25, provided that k+l+m is ≥0. In certain embodiments, k is 1 to 25, l is 1 to 25, and m is 1 to 25. In certain embodiments, k is 1 to 20, l is 1 to 20, and m is 1 to 20. In certain embodiments, k is 1 to 13, l is 1 to 13, and m is 1 to 13. In certain embodiments, k is 1 to 10, l is 1 to 10, and m is 1 to 10.

In certain embodiments, k+l+m ranges from 1 to 25. In certain embodiments, k+l+m ranges from 1 to 13. In certain embodiments, k+l+m ranges from 1 to 10. In certain embodiments, k+l+m is 1, 2, 3, 4, 5, 6, 7, 8, 9, 10, 11, 12, 13, 14, 15, 16, 17, 18, 19, 20, 21, 22, 23, 24, or 25.

In certain embodiments, k+l+m is 0. In certain embodiments x is 1, y is 1, and z is 0. In certain embodiments, x is 1, y is 0, and z is 1. In certain embodiments, x is 0, y is 1, and z is 1.

In certain embodiments, x is 1, y is 1, and z is 1. In certain embodiments, x is 1, y is 1, and z is 0. In certain embodiments, x is 1, y is 0, and z is 1. In certain embodiments, x is 0, y is 1, and z is 1. In certain embodiments, x is 1, y is 0, and z is 0. In certain embodiments, x is 0, y is 1, and z is 0. In certain embodiments, x is 0, y is 0, and z is 1.

In some embodiments, the composition includes a compound of formula (I) wherein x+y+z is 3, and $R^1$, $R^2$, and $R^3$ are each alkylenyl. In certain embodiments, the composition includes a compound of formula (I) wherein x+y+z is 3, and $R^1$, $R^2$, and $R^3$ are each $C_2$-alkylenyl. In certain embodiments, the composition includes a compound of formula (I) wherein x+y+z is 3, and $R^2$, and $R^3$ are each unsubstituted $C_2$-alkylenyl. In certain embodiments, the composition includes a compound of formula (I) wherein x is 1, y is 1, z is 0, $R^1$ and $R^2$ are each alkylenyl, and $R^3$ is alkyl. In certain embodiments, the composition includes a compound of formula (I) wherein x is 1, y is 1, z is 0, $R^1$ and $R^2$ are each $C_2$-alkylenyl, and $R^3$ is $C_1$-alkyl. In certain embodiments, the composition includes a compound of formula (I) wherein x is 1, y is 1, z is 0, $R^1$ and $R^2$ are each unsubstituted $C_2$-alkylenyl, and $R^3$ is unsubstituted $C_1$-alkyl. In certain embodiments, the composition includes a compound of formula (I) wherein x is 1, y is 1, z is 0, $R^1$ and $R^2$ are each alkylenyl, and $R^3$ is hydrogen. In certain embodiments, the composition includes a compound of formula (I) wherein x is 1, y is 1, z is 0, $R^1$ and $R^2$ are each $C_2$-alkylenyl, and $R^3$ is hydrogen. In certain embodiments, the composition includes a compound of formula (I) wherein x is 1, y is 1, z is 0, $R^1$ and $R^2$ are each unsubstituted $C_2$-alkylenyl, and $R^3$ is hydrogen.

In certain embodiments, a compound of the invention has formula (II), wherein $R^3$ is selected from the group consisting of hydrogen, alkylenyl, alkenylenyl, alkynylenyl, alkyl, alkenyl, and alkynyl, wherein said alkylenyl, alkenylenyl, alkynylenyl, alkyl, alkenyl, and alkynyl are each independently substituted or unsubstituted with one or more suitable substituents; wherein k, l, and m are each independently an integer selected from the group consisting of 0 to 25, wherein k+l+m≥0; and wherein z is 0 or 1; provided that when z is 1, $R^3$ is alkylenyl, alkenylenyl, or alkynylenyl; provided that when z is 0, $R^3$ is hydrogen, alkyl, alkenyl, or alkynyl.

(II)

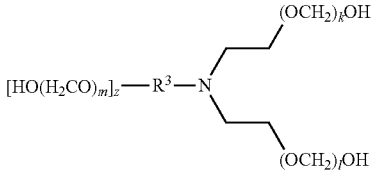

It is to be understood that when z is 0, $[HO(H_2CO)_m]$ is absent. It is also understood that when m is >0, then z must be 1. In certain embodiments, when z is 1, k is 1, and l is 1, then $R^3$ is not an unsubstituted $C_2$-alkylenyl. In certain embodiments, z is 1 and $R^3$ is alkylenyl. In certain embodiments, z is 1 and $R^3$ is $C_2$-alkylenyl. In certain embodiments, z is 1 and $R^3$ is unsubstituted $C_2$-alkylenyl. In certain embodiments, z is 0 and $R^3$ is alkyl. In certain embodiments, z is 0 and $R^3$ is $C_1$-alkyl. In certain embodiments, z is 0 and $R^3$ is unsubstituted $C_1$-alkyl. In certain embodiments, z is 0 and $R^3$ is hydrogen. In certain embodiments, k is 0 to 25, l is 0 to 25, and m is 0 to 25. In certain embodiments, k is 1 to 25, l is 1 to 25, and m is 1 to 25. In certain embodiments, k is 1 to 20, l is 1 to 20, and m is 1 to 20. In certain embodiments, k is 1 to 13, l is 1 to 13, and m is 1 to 13. In certain embodiments, k is 1 to 10, l is 1 to 10, and m is 1 to 10. In certain embodiments, k+l+m ranges from 1 to 25. In certain embodiments, k+l+m ranges from 1 to 13. In certain embodiments, k+l+m ranges from 1 to 10. In certain embodiments, k+l+m is 1, 2, 3, 4, 5, 6, 7, 8, 9, 10, 11, 12, 13, 14, 15, 16, 17, 18, 19, 20, 21, 22, 23, 24, or 25. In certain embodiments, when z is 1, k is 1, l is 1, and m is 1, then $R^3$ is not an unsubstituted $C_2$-alkylenyl.

In certain embodiments, a composition disclosed herein may have a compound of formula (III), wherein k is 0 to 25, l is 0 to 25, and m is 0 to 25, provided that k+l+m is >0. In certain embodiments, k is 1 to 25, l is 1 to 25, and m is 1 to 25. In certain embodiments, k is 1 to 20, l is 1 to 20, and m is 1 to 20. In certain embodiments, k is 1 to 13, l is 1 to 13, and m is 1 to 13. In certain embodiments, k is 1 to 10, l is 1 to 10, and m is 1 to 10. In certain embodiments, k+l+m ranges from 1 to 25. In certain embodiments, k+l+m ranges from 1 to 13. In certain embodiments, k+l+m ranges from 1 to 10. In certain embodiments, k+l+m is 1, 2, 3, 4, 5, 6, 7, 8, 9, 10, 11, 12, 13, 14, 15, 16, 17, 18, 19, 20, 21, 22, 23, 24, or 25. In certain embodiments, k, l, and m are not simultaneously 1. In certain embodiments, k, l, and m are 0.

(III)

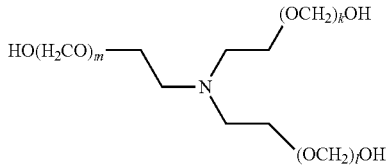

In certain embodiments, a composition disclosed herein may comprise a compound of formula (IV), wherein $R^3$ is hydrogen, alkyl, alkenyl, or alkynyl, wherein said alkyl, alkenyl, and alkynyl are each independently substituted or unsubstituted with one or more suitable substituents, and wherein k and l are each independently an integer selected from the group consisting of 0 to 25, provided that k+l is ≥0. In certain embodiments, $R^3$ is alkyl. In certain embodiments, $R^3$ is unsubstituted $C_1$-alkyl or unsubstituted $C_2$-alkyl. In certain embodiments, $R^3$ is hydrogen. In certain embodiments, k is 1 to 25, and l is 1 to 25. In certain embodiments, k is 1 to 20, and l is 1 to 20. In certain embodiments, k is 1 to 13, and l is 1 to 13. In certain embodiments, k is 1 to 10, and l is 1 to 10. In certain embodiments, k+l ranges from 1 to 25. In certain embodiments, k+l ranges from 1 to 13. In certain embodiments, k+l ranges from 1 to 10. In certain embodiments, k+l is 1, 2, 3, 4, 5, 6, 7, 8, 9, 10, 11, 12, 13, 14, 15, 16, 17, 18, 19, 20, 21, 22, 23, 24, or 25.

(IV)

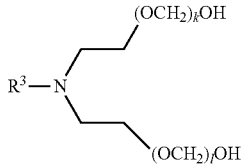

In certain embodiments, a composition disclosed herein may comprise a compound of formula (V), wherein k and l are each independently an integer selected from the group consisting of 0 to 25, provided that k+l is ≥0. In certain embodiments, k is 1 to 25, and l is 1 to 25. In certain embodiments, k is 1 to 20, and l is 1 to 20. In certain embodiments, k is 1 to 13, and l is 1 to 13. In certain embodiments, k is 1 to 10, and l is 1 to 10. In certain embodiments, k+l ranges from 1 to 25. In certain embodiments, k+l ranges from 1 to 13. In certain embodiments, k+l ranges from 1 to 10. In certain embodiments, k+l is 1, 2, 3, 4, 5, 6, 7, 8, 9, 10, 11, 12, 13, 14, 15, 16, 17, 18, 19, 20, 21, 22, 23, 24, or 25.

(V)

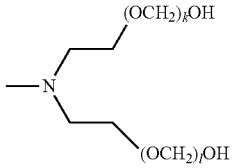

In certain embodiments, a composition disclosed herein may comprise a compound of formula (VI), wherein k and l are each independently an integer selected from the group consisting of 0 to 25, provided that k+l is ≥0. In certain embodiments, k is 1 to 25, and l is 1 to 25. In certain embodiments, k is 1 to 20, and l is 1 to 20. In certain embodiments, k is 1 to 13, and l is 1 to 13. In certain embodiments, k is 1 to 10, and l is 1 to 10. In certain embodiments, k+l ranges from 1 to 25. In certain embodiments, k+l ranges from 1 to 13. In certain embodiments, k+l ranges from 1 to 10. In certain embodiments, k+l is 1, 2, 3, 4, 5, 6, 7, 8, 9, 10, 11, 12, 13, 14, 15, 16, 17, 18, 19, 20, 21, 22, 23, 24, or 25.

(VI)

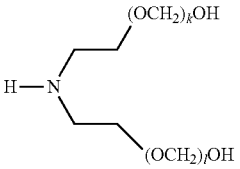

In certain embodiments, a composition disclosed herein may comprise a compound of formula (VII), wherein $R^3$, m, and z are as defined above.

(VII)

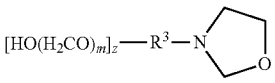

The present disclosure also provides hemiacetal compounds that are included in the inventive compositions. In some embodiments, the hemiacetal may be cyclic wherein the two oxygen atoms are incorporated into the ring structure.

In some embodiments, the hemiacetal compound may be selected from Structure 1 and/or Structure 2 below:

Structure 1

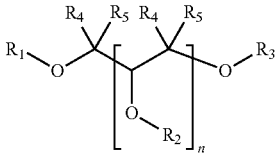

n=0, 1, 2

$R_1$, $R_2$, $R_3$=H, —$(CR_4R_5—O—)_m$—H where, m=0, 1, 2 where, n=0, 1, 2

$R_4$, $R_5$=H, alkyl, aryl, substituted or unsubstituted

Structure 2

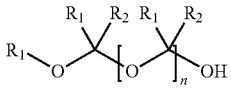

n=0, 1, 2

$R_1$=H, alkyl, aryl, substituted or unsubstituted $R_1$, $R_2$=independently selected from H & alkyl Other non-limiting examples of hemiacetal compounds include those that are based on glucose, other alcohols, thiols, amides, thioamides, urea or thiourea, such as the following:

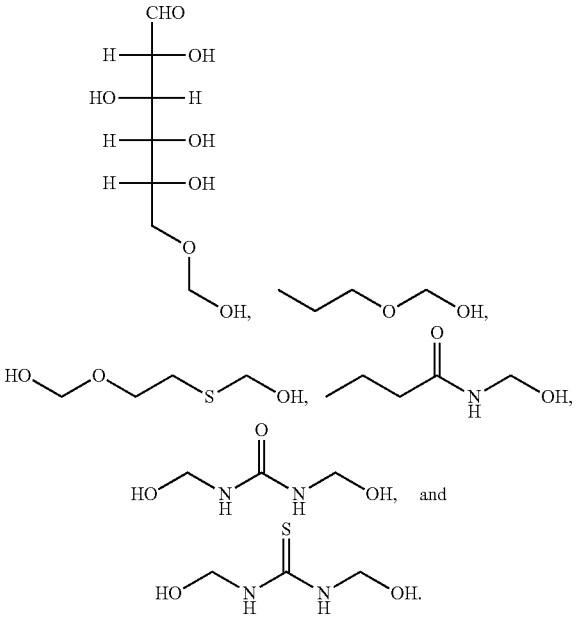

Additional examples of hemiacetal compounds include:

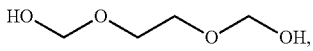

(ethane-1,2-diylbis(oxy))dimethanol)

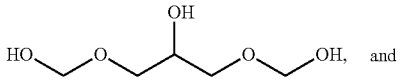

(2-hydroxypropane-1,3-diyl)bis(oxy))dimethanol)

-continued

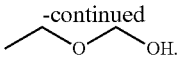

(ethoxymethanol)

The compounds of the disclosure may contain asymmetric centers and can thus occur as racemates and racemic mixtures, single enantiomers, diastereomeric mixtures and individual diastereomers. Additional asymmetric centers may be present depending upon the nature of the various substituents on the molecule. Each such asymmetric center will independently produce two optical isomers and it is intended that all of the possible optical isomers and diastereomers in mixtures and as pure or partially purified compounds are included within the scope of this invention. The present disclosure is meant to comprehend all such isomeric forms of these compounds.

3. Compositions

The compositions disclosed herein include at least one hemiacetal compound as described in the present disclosure and at least one compound containing an amine group as described in the present disclosure. For example, a composition may include a hemiacetal compound and a tertiary alkylamine compound and/or a tertiary alkanolamine compound. In some embodiments, a composition may comprise glycerol bishemiformyl and a tertiary alkylamine and/or a tertiary alkanolamine. In some embodiments, a composition may comprise glycerol bishemiformyl and triethanolamine.

The amount of each compound in the composition is not particularly limited. For example, in some embodiments, the composition comprises about 1% to about 50%, by weight, of the compound(s) containing the amine group and about 5% to about 99%, by weight, of the hemiacetal compound(s). In certain embodiments, the composition comprises about 1% to about 25%, by weight, of the compound(s) containing the amine group and about 75% to about 99%, by weight, of the hemiacetal compound(s). In some embodiments, the composition comprises about 1% to about 10%, by weight, of the compound(s) containing the amine group and about 90% to about 99%, by weight, of the hemiacetal compound(s). In particular embodiments, the composition comprises about 1% to about 5%, by weight, of the compound(s) containing the amine group and about 95% to about 99%, by weight, of the hemiacetal compound(s).

The compositions of this disclosure can optionally include one or more additives. Suitable additives include, but are not limited to, asphaltene inhibitors, paraffin inhibitors, corrosion inhibitors, scale inhibitors, emulsifiers, water clarifiers, dispersants, emulsion breakers, additional hydrogen sulfide scavengers, gas hydrate inhibitors, biocides, pH modifiers, surfactants, solvents, and any combination thereof.

Suitable asphaltene inhibitors include, but are not limited to, aliphatic sulphonic acids; alkyl aryl sulphonic acids; aryl sulfonates; lignosulfonates; alkylphenol/aldehyde resins and similar sulfonated resins; polyolefin esters; polyolefin imides; polyolefin esters with alkyl, alkylenephenyl or alkylenepyridyl functional groups; polyolefin amides; polyolefin amides with alkyl, alkylenephenyl or alkylenepyridyl functional groups; polyolefin imides with alkyl, alkylenephenyl or alkylenepyridyl functional groups; alkenyl/vinyl pyrrolidone copolymers; graft polymers of polyolefins with maleic anhydride or vinyl imidazole; hyperbranched polyester amides; polyalkoxylated asphaltenes, amphoteric fatty acids, salts of alkyl succinates, sorbitan monooleate, polyisobutylene succinic anhydride, and combinations thereof.

Suitable paraffin inhibitors include, but are not limited to, paraffin crystal modifiers, and dispersant/crystal modifier combinations. Suitable paraffin crystal modifiers include, but are not limited to, alkyl acrylate copolymers, alkyl acrylate vinylpyridine copolymers, ethylene vinyl acetate copolymers, maleic anhydride ester copolymers, branched polyethylenes, naphthalene, anthracene, microcrystalline wax and/or asphaltenes, and combinations thereof.

Suitable corrosion inhibitors include, but are not limited to, amidoamines, quaternary amines, amides, phosphate esters, and combinations thereof.

Suitable scale inhibitors include, but are not limited to, phosphates, phosphate esters, phosphoric acids, phosphonates, phosphonic acids, polyacrylamides, salts of acrylamido-methyl propane sulfonate/acrylic acid copolymer (AMPS/AA), phosphinated maleic copolymer (PHOS/MA), salts of a polymaleic acid/acrylic acid/acrylamido-methyl propane sulfonate terpolymer (PMA/AMPS), and combinations thereof.

Suitable emulsifiers include, but are not limited to, salts of carboxylic acids, products of acylation reactions between carboxylic acids or carboxylic anhydrides and amines, alkyl, acyl and amide derivatives of saccharides (alkyl-saccharide emulsifiers), and combinations thereof.

Suitable water clarifiers include, but are not limited to, inorganic metal salts such as alum, aluminum chloride, and aluminum chlorohydrate, or organic polymers such as acrylic acid based polymers, acrylamide based polymers, polymerized amines, alkanolamines, thiocarbamates, cationic polymers such as diallyldimethylammonium chloride (DADMAC), and combinations thereof.

Suitable dispersants include, but are not limited to, aliphatic phosphonic acids with 2-50 carbons, such as hydroxyethyl diphosphonic acid, and aminoalkyl phosphonic acids, e.g. polyaminomethylene phosphonates with 2-10 N atoms e.g. each bearing at least one methylene phosphonic acid group; examples of the latter are ethylenediamine tetra(methylene phosphonate), diethylenetriamine penta(methylene phosphonate) and the triamine- and tetramine-polymethylene phosphonates with 2-4 methylene groups between each N atom, at least 2 of the numbers of methylene groups in each phosphonate being different. Other suitable dispersion agents include lignin or derivatives of lignin such as lignosulfonate and naphthalene sulfonic acid and derivatives, and combinations thereof.

Suitable emulsion breakers include, but are not limited to, dodecylbenzylsulfonic acid (DDBSA), the sodium salt of xylenesulfonic acid (NAXSA), epoxylated and propoxylated compounds, anionic cationic and nonionic surfactants, resins such as phenolic and epoxide resins, and combinations thereof.

Suitable additional hydrogen sulfide scavengers include, but are not limited to, oxidants (e.g., inorganic peroxides such as sodium peroxide, or chlorine dioxide), aldehydes (e.g., of 1-10 carbons such as formaldehyde or glutaraldehyde or (meth)acrolein), triazines (e.g., monoethanol amine triazine, monomethylamine triazine, and triazines from multiple amines or mixtures thereof), glyoxal, and combinations thereof.

Suitable gas hydrate inhibitors include, but are not limited to, thermodynamic hydrate inhibitors (THI), kinetic hydrate inhibitors (KHI), anti-agglomerates (AA), and combinations thereof. Suitable thermodynamic hydrate inhibitors include, but are not limited to, NaCl salt, KCl salt, $CaCl_2$ salt, $MgCl_2$ salt, $NaBr_2$ salt, formate brines (e.g. potassium formate), polyols (such as glucose, sucrose, fructose, maltose, lactose, gluconate, monoethylene glycol, diethylene glycol, triethylene glycol, mono-propylene glycol, dipropylene glycol, tripropylene glycols, tetrapropylene glycol, monobutylene glycol, dibutylene glycol, tributylene glycol, glycerol, diglycerol, triglycerol, and sugar alcohols (e.g. sorbitol, mannitol)), methanol, propanol, ethanol, glycol ethers (such as diethyleneglycol monomethylether, ethyleneglycol monobutylether), alkyl or cyclic esters of alcohols (such as ethyl lactate, butyl lactate, methylethyl benzoate), and combinations thereof. Suitable kinetic hydrate inhibitors and anti-agglomerates include, but are not limited to, polymers and copolymers, polysaccharides (such as hydroxy-ethylcellulose (HEC), carboxymethylcellulose (CMC), starch, starch derivatives, and xanthan), lactams (such as polyvinylcaprolactam, polyvinyl lactam), pyrrolidones (such as polyvinyl pyrrolidone of various molecular weights), surfactants (such as fatty acid salts, ethoxylated alcohols, propoxylated alcohols, sorbitan esters, ethoxylated sorbitan esters, polyglycerol esters of fatty acids, alkyl glucosides, alkyl polyglucosides, alkyl sulfates, alkyl sulfonates, alkyl ester sulfonates, alkyl aromatic sulfonates, alkyl betaine, alkyl amido betaines), hydrocarbon based dispersants (such as lignosulfonates, iminodisuccinates, polyaspartates), amino acids, proteins, and combinations thereof.

Suitable biocides include, but are not limited to, oxidizing and non-oxidizing biocides. Suitable non-oxidizing biocides include, for example, aldehydes (e.g., formaldehyde, glutaraldehyde, and acrolein), amine-type compounds (e.g., quaternary amine compounds and cocodiamine), halogenated compounds (e.g., bronopol and 2-2-dibromo-3-nitrilopropionamide (DBNPA)), sulfur compounds (e.g., isothiazolone, carbamates, and metronidazole), quaternary phosphonium salts (e.g., tetrakis(hydroxymethyl)phosphonium sulfate (THPS)), and combinations thereof. Suitable oxidizing biocides include, for example, sodium hypochlorite, trichloroisocyanuric acids, dichloroisocyanuric acid, calcium hypochlorite, lithium hypochlorite, chlorinated hydantoins, stabilized sodium hypobromite, activated sodium bromide, brominated hydantoins, chlorine dioxide, ozone, peroxides, and combinations thereof.

Suitable pH modifiers include, but are not limited to, alkali hydroxides, alkali carbonates, alkali bicarbonates, alkaline earth metal hydroxides, alkaline earth metal carbonates, alkaline earth metal bicarbonates and mixtures or combinations thereof. Exemplary pH modifiers include NaOH, KOH, $Ca(OH)_2$, CaO, $Na_2CO_3$, $KHCO_3$, $K_2CO_3$, $NaHCO_3$, MgO, and $Mg(OH)_2$.

Suitable surfactants include, but are not limited to, anionic surfactants, cationic surfactants, nonionic surfactants, and combinations thereof. Anionic surfactants include alkyl aryl sulfonates, olefin sulfonates, paraffin sulfonates, alcohol sulfates, alcohol ether sulfates, alkyl carboxylates and alkyl ether carboxylates, and alkyl and ethoxylated alkyl phosphate esters, and mono and dialkyl sulfosuccinates and sulfosuccinamates, and combinations thereof. Cationic surfactants include alkyl trimethyl quaternary ammonium salts, alkyl dimethyl benzyl quaternary ammonium salts, dialkyl dimethyl quaternary ammonium salts, imidazolinium salts, and combinations thereof. Nonionic surfactants include alcohol alkoxylates, alkylphenol alkoxylates, block copolymers of ethylene, propylene and butylene oxides, alkyl dimethyl amine oxides, alkyl-bis(2-hydroxyethyl) amine oxides, alkyl amidopropyl dimethyl amine oxides, alkylamidopropyl-bis(2-hydroxyethyl) amine oxides, alkyl polyglucosides, polyalkoxylated glycerides, sorbitan esters and polyalkoxylated sorbitan esters, and alkoyl polyethylene glycol esters and diesters, and combinations thereof. Also included are betaines and sultanes, amphoteric surfactants such as alkyl amphoacetates and amphodiacetates, alkyl amphopropripionates and amphodipropionates, alkyliminodiproprionate, and combinations thereof.

In certain embodiments, the surfactant may be a quaternary ammonium compound, an amine oxide, an ionic or non-ionic surfactant, or any combination thereof. Suitable quaternary amine compounds include, but are not limited to, alkyl benzyl ammonium chloride, benzyl cocoalkyl($C_{12}$-$C_{18}$)dimethylammonium chloride, dicocoalkyl ($C_{12}$-$C_{18}$)dimethylammonium chloride, ditallow dimethylammonium chloride, di(hydrogenated tallow alkyl)dimethyl quaternary ammonium methyl chloride, methyl bis(2-hydroxyethyl cocoalkyl($C_{12}$-$C_{18}$) quaternary ammonium chloride, dimethyl(2-ethyl) tallow ammonium methyl sulfate, n-dodecylbenzyldimethylammonium chloride, n-octadecylbenzyldimethyl ammonium chloride, n-dodecyltrimethylammonium sulfate, soya alkyltrimethylammonium chloride, and hydrogenated tallow alkyl (2-ethylhyexyl) dimethyl quaternary ammonium methyl sulfate.

Suitable solvents include, but are not limited to, water, isopropanol, methanol, ethanol, 2-ethylhexanol, heavy aromatic naphtha, toluene, ethylene glycol, ethylene glycol monobutyl ether (EGMBE), diethylene glycol monoethyl ether, xylene, and combinations thereof. Representative polar solvents suitable for formulation with the composition include water, brine, seawater, alcohols (including straight chain or branched aliphatic such as methanol, ethanol, propanol, isopropanol, butanol, 2-ethylhexanol, hexanol, octanol, decanol, 2-butoxyethanol, etc.), glycols and derivatives (ethylene glycol, 1,2-propylene glycol, 1,3-propylene glycol, ethylene glycol monobutyl ether, etc.), ketones (cyclohexanone, diisobutylketone), N-methylpyrrolidinone (NMP), N,N-dimethylformamide and the like. Representative of non-polar solvents suitable for formulation with the composition include aliphatics such as pentane, hexane, cyclohexane, methylcyclohexane, heptane, decane, dodecane, diesel, and the like; aromatics such as toluene, xylene, heavy aromatic naphtha, fatty acid derivatives (acids, esters, amides), and the like.

In certain embodiments, the solvent is a polyhydroxylated solvent, a polyether, an alcohol, or a combination thereof.

In certain embodiments, the solvent is monoethyleneglycol, methanol, dimethyl sulfoxide (DMSO), dimethylformamide (DMF), tetrahydrofuran (THF), or a combination thereof.

In certain embodiments, a composition may comprise from about 0 to about 90% by weight of one or more solvents, based on the weight of the composition. In certain embodiments, a composition may comprise from about 0 to about 50% by weight of one or more solvents, based on the weight of the composition. In certain embodiments, a composition may comprise about 10%, about 15%, about 20%, about 25%, about 30%, about 35%, about 40%, about 45%, about 50%, about 55%, about 60%, about 65%, about 70%, about 75%, about 80%, about 85%, or about 90% by weight of one or more solvents, based on the weight of the composition.

Compositions of the present disclosure may further include additional functional agents or additives that provide a beneficial property. Additional agents or additives will vary according to the particular scavenging composition being manufactured and the intended use of the composition, as one skilled in the art will appreciate. In some embodiments, compositions do not contain any of the additional agents or additives but simply contain a hemiacetal compound, a compound containing an amine group, and optionally a solvent.

4. Methods of Use

The compounds and compositions of the present disclosure may be used for sweetening a gas and/or a liquid, such as a sour gas or a sour liquid. The compounds and compositions may be used for scavenging hydrogen-containing compounds, such as hydrogen sulfide and/or mercaptans, from a gas or liquid stream by treating said stream with an effective amount of a compound or composition as described herein. The compounds and compositions of this disclosure can be used in any industry where it is desirable to capture hydrogen sulfide and/or mercaptans from a gas or liquid stream. In certain embodiments, the compounds and compositions can be used in water systems, condensate/oil systems/gas systems, or any combination thereof. In certain embodiments, the compounds and compositions can be applied to a gas or liquid produced or used in the production, transportation, storage, and/or separation of crude oil or natural gas. In certain embodiments, the compounds and compositions can be applied to a gas stream used or produced in a coal-fired process, such as a coal-fired power plant. In certain embodiments, the compounds and compositions can be applied to a gas or liquid produced or used in a waste-water process, a farm, a slaughter house, a land-fill, a municipality waste-water plant, a coking coal process, or a biofuel process.

In certain embodiments, the methods include treating a fluid or gas with an effective amount of a composition comprising a hemiacetal compound (or mixture of any number of hemiacetal compounds) and one or more amine-containing compounds, one or more tertiary alkylamine compounds, one or more tertiary alkanolamine compounds, one or more compounds of formula (I), one or more compounds of formula (II), and/or mixtures of any of the foregoing.

The compounds and compositions may be added to any fluid or gas containing hydrogen sulfide and/or a mercaptan, or a fluid or gas that may be exposed to hydrogen sulfide and/or a mercaptan. A fluid to which the compounds and compositions may be introduced may be an aqueous medium. In some embodiments, the aqueous medium may comprise water, gas, and optionally liquid hydrocarbon. A fluid to which the compounds and compositions may be introduced may be a liquid hydrocarbon. The liquid hydrocarbon may be any type of liquid hydrocarbon including, but not limited to, crude oil, heavy oil, processed residual oil, bituminous oil, coker oils, coker gas oils, fluid catalytic cracker feeds, gas oil, naphtha, fluid catalytic cracking slurry, diesel fuel, fuel oil, jet fuel, gasoline, and kerosene. In certain embodiments, the gas may be a sour gas. In certain embodiments, the fluid or gas may be a refined hydrocarbon product.

A fluid or gas treated with a compound or composition of this disclosure may be at any selected temperature, such as ambient temperature or a temperature above ambient temperature. In certain embodiments, the fluid (e.g., liquid hydrocarbon) or gas may be at a temperature of from about 40° C. to about 250° C. In certain embodiments, the fluid or gas may be at a temperature of from −50° C. to 300° C., 0° C. to 200° C., 10° C. to 100° C., or 20° C. to 90° C. In certain embodiments, the fluid or gas may be at a temperature of 22° C., 23° C., 24° C., 25° C., 26° C., 27° C., 28° C., 29° C., 30° C., 31° C., 32° C., 33° C., 34° C., 35° C., 36° C., 37° C., 38° C., 39° C., or 40° C. In certain embodiments, the fluid or gas may be at a temperature of 85° C., 86° C., 87° C., 88° C., 89° C., 90° C., 91° C., 92° C., 93° C., 94° C., 95° C., 96° C., 97° C., 98° C., 99° C., or 100° C.

The compounds and compositions of this disclosure may be added to a fluid at various levels of water cut. For example, the water cut may be from 0% to 100% volume/volume (v/v), from 1% to 80% v/v, or from 1% to 60% v/v. The fluid can be an aqueous medium that contains various levels of salinity. In one embodiment, the fluid may have a salinity of 0% to 25%, about 1% to 24%, or about 10% to 25% weight/weight (w/w) total dissolved solids (TDS).

The fluid or gas in which the compounds and compositions of this disclosure are introduced may be contained in and/or exposed to many different types of devices. For example, the fluid or gas may be contained in an apparatus that transports fluid or gas from one point to another, such as an oil and/or gas pipeline. In certain embodiments, the apparatus may be part of an oil and/or gas refinery, such as a pipeline, a separation vessel, a dehydration unit, or a gas line. The fluid may be contained in and/or exposed to an apparatus used in oil extraction and/or production, such as a wellhead. The apparatus may be part of a coal-fired power plant. The apparatus may be a scrubber (e.g., a wet flue gas desulfurizer, a spray dry absorber, a dry sorbent injector, a spray tower, a contact or bubble tower, or the like). The apparatus may be a cargo vessel, a storage vessel, a holding tank, or a pipeline connecting the tanks, vessels, or processing units. In certain embodiments, the fluid or gas may be contained in water systems, condensate/oil systems/gas systems, or any combination thereof.

The compounds or compositions of this disclosure may be introduced into a fluid or gas by any appropriate method for ensuring dispersal of the scavenger through the fluid or gas. The compounds and compositions may be injected using mechanical equipment such as chemical injection pumps, piping tees, injection fittings, atomizers, quills, and the like. The compounds and compositions may be introduced with or without one or more additional polar or non-polar solvents depending upon the application and requirements. In certain embodiments, the compounds and compositions may be pumped into an oil and/or gas pipeline using an umbilical line. In certain embodiments, capillary injection systems can be used to deliver the compounds and compositions to a selected fluid. In certain embodiments, the compounds and compositions can be introduced into a liquid and mixed. In certain embodiments, the compounds and compositions can be injected into a gas stream as an aqueous or nonaqueous solution, mixture, or slurry. In certain embodiments, the fluid or gas may be passed through an absorption tower comprising a compound or composition of the invention.

The compounds and compositions may be applied to a fluid or gas to provide a scavenger concentration of about 1 parts per million (ppm) to about 1,000,000 ppm, about 1 parts per million (ppm) to about 100,000 ppm, about 10 ppm to about 75,000 ppm, about 100 ppm to about 45,000 ppm, about 500 ppm to about 40,000 ppm, about 1,000 ppm to about 35,000 ppm, about 3,000 ppm to about 30,000 ppm, about 4,000 ppm to about 25,000 ppm, about 5,000 ppm to about 20,000 ppm, about 6,000 ppm to about 15,000 ppm, or about 7,000 ppm to about 10,000 ppm.

The compounds and compositions may be applied to a fluid at a concentration of about 100 ppm to about 2,000 ppm, about 200 ppm to about 1,500 ppm, or about 500 ppm to about 1000 ppm.

Each system may have its own requirements, and a more sour gas (e.g., containing more hydrogen sulfide) may require a higher dose rate of a compound or composition. In certain embodiments, the compounds and compositions may be applied to a fluid or gas in an equimolar amount or greater relative to hydrogen sulfide and/or mercaptans present in the fluid or gas. In certain embodiments, the compounds and compositions may be applied to a fluid or gas as a neat composition (e.g., the compounds and compositions may be used neat in a contact tower).

The hydrogen sulfide and/or mercaptan in a fluid or gas may be reduced by any amount by treatment with a compound or composition of this disclosure. The actual amount of residual hydrogen sulfide and/or mercaptan after treatment may vary depending on the starting amount. In certain embodiments, the hydrogen sulfide and/or mercaptan levels may be reduced to about 150 ppm by volume or less, as measured in the vapor phase, based on the volume of the liquid media. In certain embodiments, the hydrogen sulfide levels and/or mercaptan may be reduced to 100 ppm by volume or less, as measured in the vapor phase, based on the volume of the liquid media. In certain embodiments, the hydrogen sulfide and/or mercaptan levels may be reduced to 50 ppm by volume or less, as measured in the vapor phase, based on the volume of the liquid media. In certain embodiments, the hydrogen sulfide and/or mercaptan levels may be reduced to 20 ppm by volume or less, as measured in the vapor phase, based on the volume of the liquid media. In certain embodiments, the hydrogen sulfide and/or mercaptan levels may be reduced to 15 ppm by volume or less, as measured in the vapor phase, based on the volume of the liquid media. In certain embodiments, the hydrogen sulfide and/or mercaptan levels may be reduced to 10 ppm by volume or less, as measured in the vapor phase, based on the volume of the liquid media. In certain embodiments, the hydrogen sulfide and/or mercaptan levels may be reduced to 5 ppm by volume or less, as measured in the vapor phase, based on the volume of the liquid media. In certain embodiments, the hydrogen sulfide and/or mercaptan levels may be reduced to 0 ppm by volume, as measured in the vapor phase, based on the volume of the liquid media.

In certain embodiments, the compounds and compositions of this disclosure may be soluble in an aqueous phase such that the captured sulfur-based species will migrate into the aqueous phase. If an emulsion is present, the captured sulfur-based species can be migrated into the aqueous phase from a hydrocarbon phase (e.g., crude oil) and removed with the aqueous phase. If no emulsion is present, a water wash can be added to attract the captured sulfur-based species. In certain embodiments, the compounds and compositions can be added before a hydrocarbon (e.g., crude oil) is treated in a desalter, which emulsifies the hydrocarbon media with a water wash to extract water soluble contaminants and separates and removes the water phase from the hydrocarbon.

In certain embodiments, a water wash may be added in an amount suitable for forming an emulsion with a hydrocarbon. In certain embodiments, the water wash may be added in an amount of from about 1 to about 50 percent by volume based on the volume of the emulsion. In certain embodiments, the wash water may be added in an amount of from about 1 to about 25 percent by volume based on the volume of the emulsion. In certain embodiments, the wash water may be added in an amount of from about 1 to about 10 percent by volume based on the volume of the emulsion. In certain embodiments, the amount of hydrocarbon may be present in an amount of from about 50 to about 99 percent by volume based on the volume of the emulsion. In certain embodiments, the hydrocarbon may be present in an amount of from about 75 to about 99 percent by volume based on the volume of the emulsion. In certain embodiments, the hydrocarbon may be present in an amount of from about 90 to about 99 percent by volume based on the volume of the emulsion.

The water wash and hydrocarbon may be emulsified by any conventional manner. In certain embodiments, the water wash and hydrocarbon may be heated and thoroughly mixed to produce an oil-in-water emulsion. In certain embodiments, the water wash and hydrocarbon may be heated at a temperature in a range of from about 90° C. to about 150° C. The water wash and hydrocarbon may be mixed in any conventional manner, such as an in-line static mixer or an in-line mix valve with a pressure drop of about 0.2 to about 2 bar depending on the density of the hydrocarbon. The emulsion may be allowed to separate, such as by settling, into an aqueous phase and an oil phase. In certain embodiments, the aqueous phase may be removed. In another embodiment, the aqueous phase may be removed by draining the aqueous phase.

Optionally, demulsifiers may be added to aid in separating water from the hydrocarbon. In certain embodiments, the demulsifiers include, but are not limited to, oxyalkylated organic compounds, anionic surfactants, nonionic surfactants or mixtures of these materials. The oxyalkylated organic compounds include, but are not limited to, phenol-formaldehyde resin ethoxylates and alkoxylated polyols. The anionic surfactants include alkyl or aryl sulfonates, such as dodecylbenzenesulfonate. These demulsifiers may be added in amounts to contact the water from about 1 to about 1000 ppm by weight based on the weight of the hydrocarbon.

In certain embodiments, the methods disclosed herein reduce hydrogen sulfide levels in the treated fluid or gas stream by at least about 90%, about 95%, or about 99%.

The compounds, compositions, and methods of the present disclosure will be better understood by reference to the following examples, which are intended as an illustration of and not a limitation upon the scope of this disclosure.

5. Examples

The foregoing may be better understood by reference to the following examples, which are presented for purposes of illustration and are not intended to limit the scope of the invention.

Exploratory experiments were conducted using biodiesel-generated glycerol. A composition comprising about 40%, by weight, glycerol hemiformyl and about 60%, by weight, of the following Molecule A:

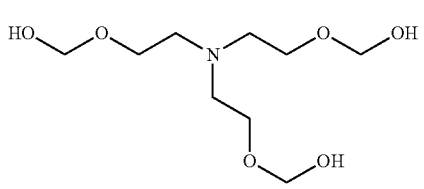

Molecule A yielded rapid hydrogen sulfide removal at about 100% conversion.

Additional experiments were conducted wherein a measured amount of a hemiformyl was placed in a bubble tower and diluted with water. The unit was sealed and pressurized to 30 psia with nitrogen. Hydrogen sulfide was introduced as a 10% gas mixture in carbon dioxide (5%) and nitrogen (85%) at a known flow rate at ambient temperature, typically about 25° C.

When a known amount of 100% glycerin hemi-formyl was tested, breakthrough was almost immediate as evidenced in FIG. 1. When a composition comprising about 60% glycerin hemi-formyl and about 40% Molecule A was tested, less than 1 ppm of hydrogen sulfide was detected in effluent gas over a five hour period with hydrogen sulfide efficiencies exceeding 95%. The synergistic effect of the alkanolamine was immediate and long-lasting.

Additional testing was conducted using triethanolamine with glycerin hemi-formyl (GT-227) and triethanolamine with ethylene glycol hemi-formyl (GT-251). For these experiments, the hydrogen sulfide was introduced as a 2% mixture (20,000 ppm) in carbon dioxide/nitrogen. The results of these experiments can be seen in FIGS. 2 and 3.

Figure 2:
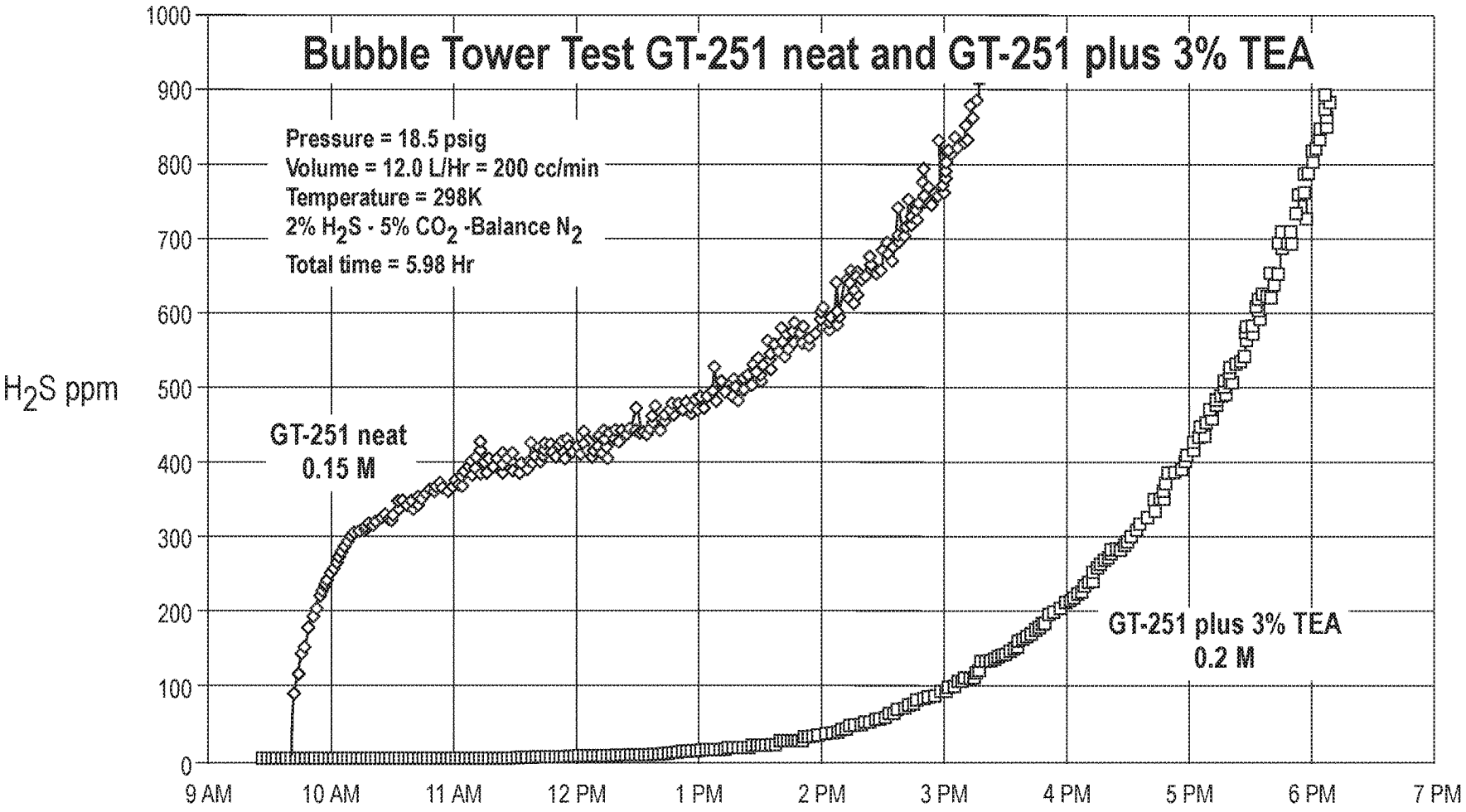

As can be seen, the addition of triethanolamine to an aqueous solution of GT-251 (MEG (ethylene glycol) based) does not increase the overall molar capacity of hydrogen sulfide removal. However, the synergistic impact of triethanolamine on hemi-formyl hydrogen sulfide efficiency is clearly demonstrated. In FIG. 2, the effluent gas mixture has no hydrogen sulfide for about 4 hours.

Figure 3:
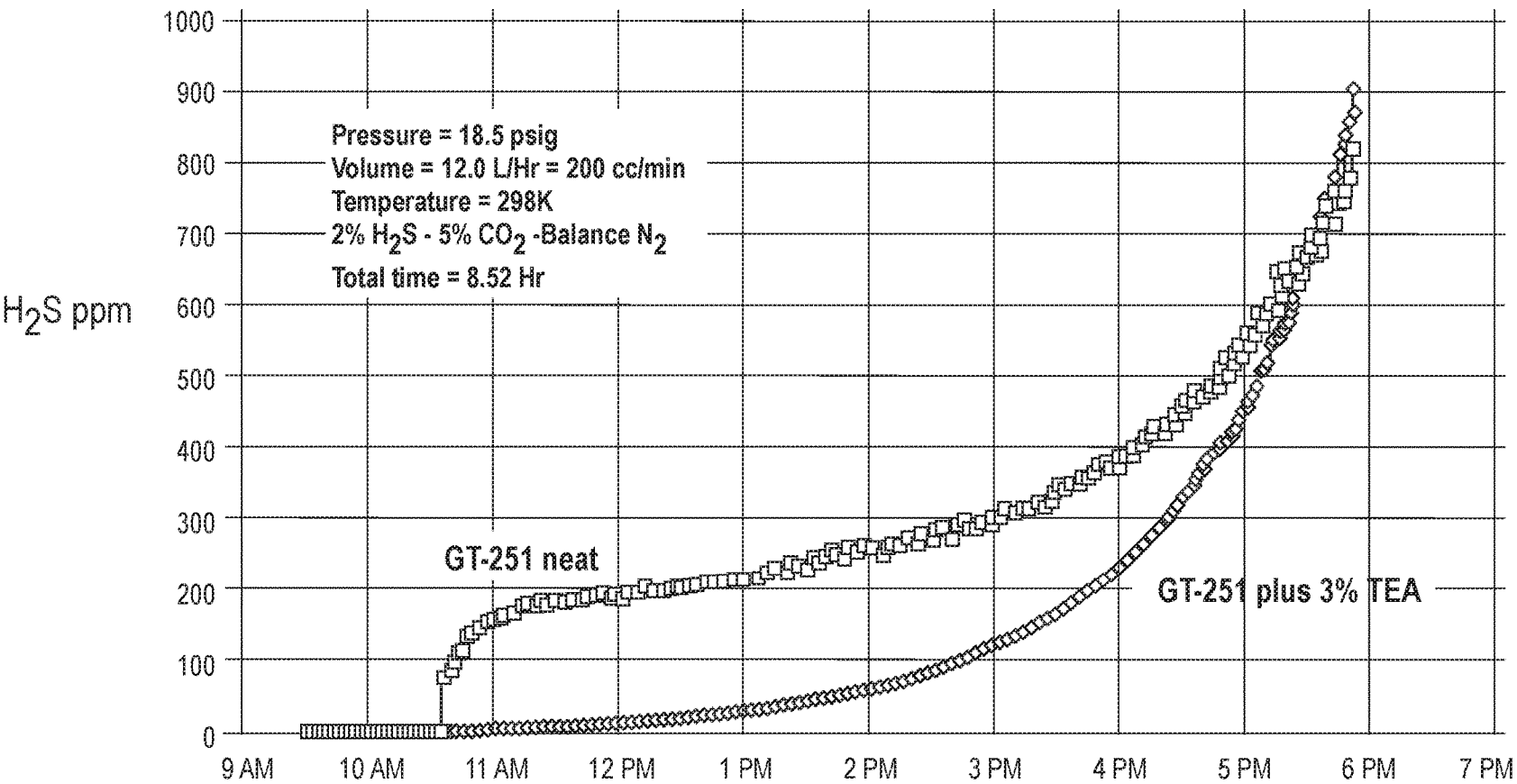

The synergistic effect of triethanolamine on GT-227 is shown in FIG. 3.

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. Any and all patents, patent applications, scientific papers, and other references cited in this application, as well as any references cited therein, are hereby incorporated by reference in their entirety.

What is claimed is:

1. A method of removing a sulfur-containing compound from a stream, comprising:

adding a composition to the stream comprising the sulfur-containing compound, the composition comprising a compound containing an amine group and a hemiacetal compound, wherein the compound containing the amine group comprises formula (I):

(I)

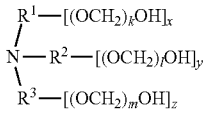

wherein $R^1$, $R^2$, and $R^3$ are each independently selected from the group consisting of hydrogen, alkylenyl, alkenylenyl, alkynylenyl, alkyl, alkenyl, alkynyl, and aryl, wherein said alkylenyl, alkenylenyl, alkynylenyl, alkyl, alkenyl, and alkynyl are each independently, at each occurrence, substituted or unsubstituted with one or more suitable substituents;

k, l, and m are each independently an integer selected from the group consisting of 0 to 25, wherein k+l+m is ≥0; and x, y, and z are each independently an integer selected from the group consisting of 0 and 1, wherein x+y+z is 1 or 2;

provided that:

at least one of $R^1$, $R^2$ or $R^3$ is aryl and at least one of $R^1$, $R^2$ or $R^3$ is hydrogen.

2. The method of claim 1, wherein the stream is a liquid or a gaseous stream comprising a hydrocarbon.

3. The method of claim 1, wherein the sulfur-containing compound is hydrogen sulfide.

4. The method of claim 1, wherein the hemiacetal compound comprises the following Structure 1:

Structure 1

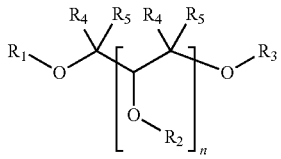

wherein n=0, 1, or 2;

$R_1$, $R_2$, and $R_3$=H or —$(CR_4R_5—O—)_m$—H;

m=0, 1, or 2; and $R_4$ and $R_5$=H, substituted or unsubstituted alkyl, and substituted or unsubstituted aryl.

5. The method of claim 1, wherein the hemiacetal compound comprises the following structure 2:

Structure 2

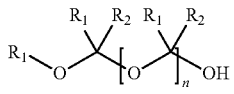

wherein n=0, 1, or 2; and $R_1$ and $R_2$=H, substituted or unsubstituted alkyl, and substituted or unsubstituted aryl.

6. The method of claim 1, wherein the hemiacetal compound is selected from the group consisting of

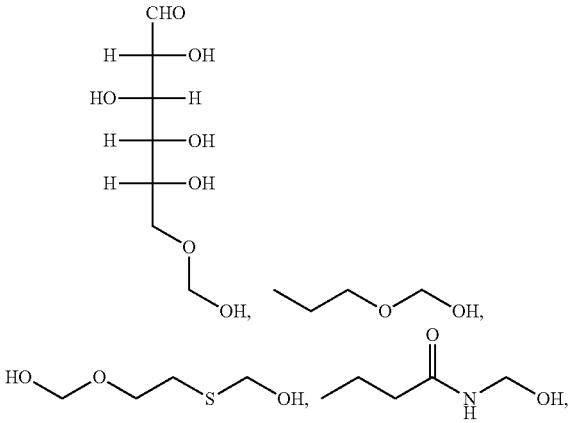

-continued

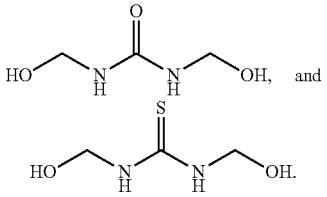

7. The method of claim 1, wherein the hemiacetal compound is selected from the group consisting of

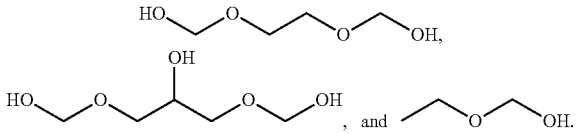

8. A method of removing a sulfur-containing compound from a stream, comprising:

adding a composition to the stream comprising the sulfur-containing compound, the composition comprising a compound containing an amine group and a hemiacetal compound, wherein the compound containing the amine group comprises formula (I):

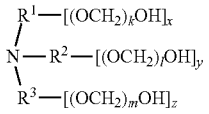

(I)

wherein k, l, and m are each 0;

x, y, and z are each 1;

$R^1$ and $R^2$ are both alkylenyl; and $R^3$ is aryl.

9. The method of claim 8, wherein the hemiacetal compound comprises the following Structure 1:

Structure 1

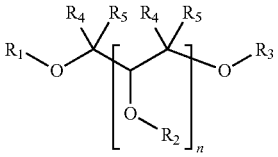

wherein n=0, 1, or 2;

$R_1$, $R_2$, and $R_3$=H or —$(CR_4R_5—O—)_m$—H;

m=0, 1, or 2; and $R_4$ and $R_5$=H, substituted or unsubstituted alkyl, and substituted or unsubstituted aryl.

10. The method of claim 8, wherein the hemiacetal compound comprises the following structure 2:

Structure 2

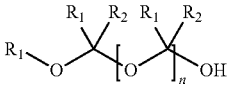

wherein n=0, 1, or 2; and $R_1$ and $R_2$=H, substituted or unsubstituted alkyl, and substituted or unsubstituted aryl.

11. The method of claim 8, wherein the hemiacetal compound is selected from the group consisting of

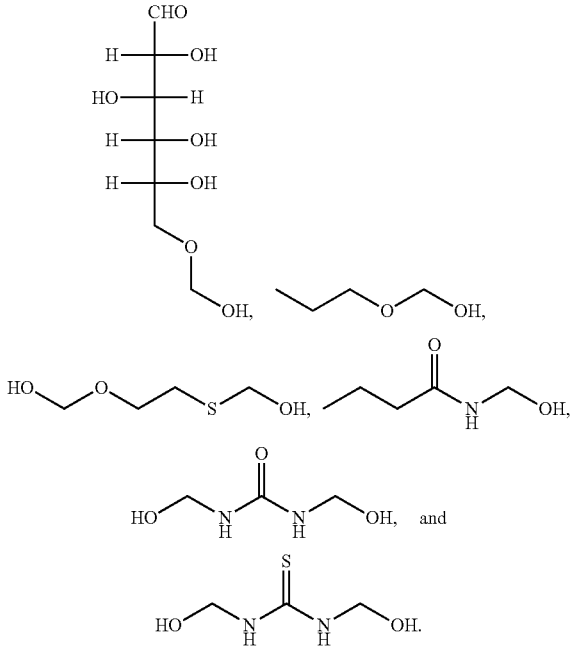

12. The method of claim 8, wherein the hemiacetal compound is selected from the group consisting of

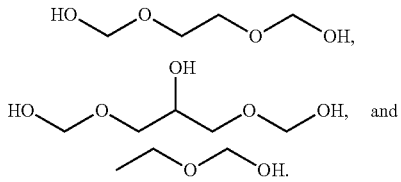

13. A method of removing a sulfur-containing compound from a stream, comprising:

adding a composition to the stream comprising the sulfur-containing compound, the composition comprising a compound containing an amine group and a hemiacetal compound, wherein the compound containing the amine group comprises the following formula:

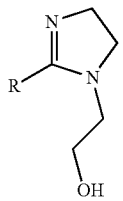

Imidazoline Mixtures

R = $C_2$-$C_{17}$

14. The method of claim 13, wherein the hemiacetal compound comprises the following Structure 1:

Structure 1

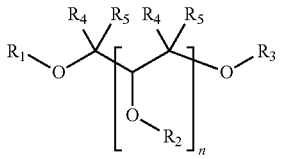

wherein n=0, 1, or 2;

$R_1$, $R_2$, and $R_3$=H or —$(CR_4R_5—O—)_m$—H;

m=0, 1, or 2; and $R_4$ and $R_5$=H, substituted or unsubstituted alkyl, and substituted or unsubstituted aryl.

15. The method of claim 13, wherein the hemiacetal compound comprises the following structure 2:

Structure 2

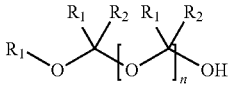

wherein n=0, 1, or 2; and $R_1$ and $R_2$=H, substituted or unsubstituted alkyl, and substituted or unsubstituted aryl.

16. The method of claim 13, wherein the hemiacetal compound is selected from the group consisting of

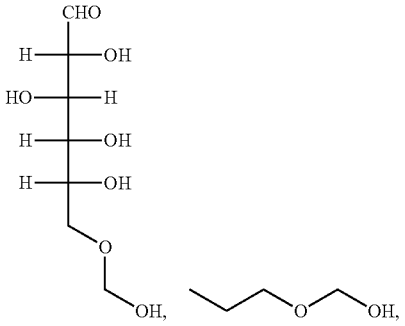

-continued

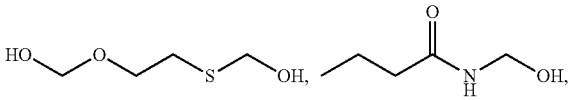

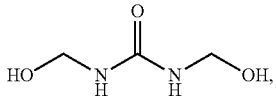

and

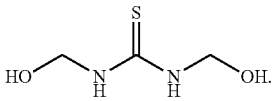

17. The method of claim 13, wherein the hemiacetal compound is selected from the group consisting of

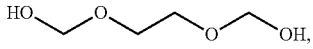

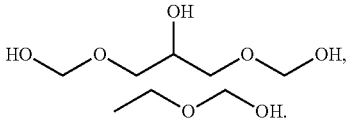

and

* * * * *